US008365452B2

(12) United States Patent
Goldman

(10) Patent No.: US 8,365,452 B2
(45) Date of Patent: Feb. 5, 2013

(54) DISPLAY FRAME

(75) Inventor: Benjamin A. Goldman, Weehawken, NJ (US)

(73) Assignee: United Visual Arts, LLC, Weehawken, NJ (US)

( * ) Notice: Subject to any disclaimer, the term of this patent is extended or adjusted under 35 U.S.C. 154(b) by 383 days.

(21) Appl. No.: 11/776,100

(22) Filed: Jul. 11, 2007

(65) Prior Publication Data

US 2008/0010887 A1 Jan. 17, 2008

Related U.S. Application Data

(63) Continuation-in-part of application No. 11/381,280, filed on Jun. 8, 2006, now abandoned.

(60) Provisional application No. 60/677,290, filed on May 3, 2005, provisional application No. 60/729,618, filed on Oct. 24, 2005.

(51) Int. Cl.
*A47G 1/06* (2006.01)

(52) U.S. Cl. ..... 40/781; 40/771

(58) Field of Classification Search ..... 40/704, 40/706, 774, 772, 777, 661, 705
See application file for complete search history.

(56) References Cited

U.S. PATENT DOCUMENTS

| | | | | | |
|---|---|---|---|---|---|
| 2,361,479 | A | * | 10/1944 | Joffo | 40/204 |
| 2,823,478 | A | * | 2/1958 | Ostergaard et al. | 40/707 |
| 2,837,854 | A | * | 6/1958 | Bing et al. | 40/706 |
| 2,874,498 | A | * | 2/1959 | Butkevich | 40/705 |
| 3,369,451 | A | * | 2/1968 | Brandt et al. | 40/704 |
| 4,165,572 | A | * | 8/1979 | Sussman | 40/661 |
| 4,249,328 | A | * | 2/1981 | Plumadore | 40/702 |
| 4,332,095 | A | * | 6/1982 | Tanney | 40/771 |
| 4,351,123 | A | | 9/1982 | Cross | |
| 4,387,807 | A | * | 6/1983 | de la Rosa | 206/312 |
| 4,903,829 | A | * | 2/1990 | Clemens | 206/308.1 |
| 4,979,619 | A | * | 12/1990 | Hager | 206/509 |
| 4,984,798 | A | | 1/1991 | Silberstein | |
| 5,148,618 | A | * | 9/1992 | Brewster | 40/626 |
| 5,385,231 | A | * | 1/1995 | Nowotny | 206/309 |
| 5,699,913 | A | * | 12/1997 | Richardson | 206/470 |
| 5,713,463 | A | * | 2/1998 | Lakoski et al. | 206/308.1 |
| 6,070,350 | A | * | 6/2000 | Fantone et al. | 40/454 |
| 6,253,473 | B1 | | 7/2001 | Collins | |
| 6,470,612 | B1 | | 10/2002 | Pountney | |

FOREIGN PATENT DOCUMENTS

| | | |
|---|---|---|
| DE | 29801466 U1 | 4/1998 |
| EP | 1627585 A1 | 2/2006 |

* cited by examiner

*Primary Examiner* — Tashiana Adams
*Assistant Examiner* — Christopher E Veraa
(74) *Attorney, Agent, or Firm* — Lucas & Mercanti, LLP

(57) ABSTRACT

The display frame has a transparent front and back panel with friction clamps that interact to close the frame around a content, or has a transparent folded outer glazing that holds an inside assembly around a content. The frictional clamp and the folded outer glazing and inside assembly allow the frame to be opened and the content to be replaced. A hanging-bumper device protrudes from the back of the frame either as an integral component of the back panel, outer glazing, or inside assembly, or as a removable attachment.

4 Claims, 31 Drawing Sheets

DISPLAY FRAME

CROSS-REFERENCE TO RELATED APPLICATION

This application is a Continuation in Part of prior application Ser. No. 11/381,280, filed on Jun. 8, 2006, which claims the priority of U.S. provisional applications 60/677,290 and 60/729,618; all of which are hereby incorporated by reference for all purposes.

FIELD OF THE INVENTION

The present invention relates to a display frame for displaying or storing art and documents. More specifically, the invention is a transparent display frame that reduces the typical number of component parts to as few as two, allows for viewing the front and back of artwork and or documents, and also allows for easily replacing such contents.

BACKGROUND OF THE INVENTION

There is an extensive prior art for display frames, involving a multitude of designs and components, including molding, glazing, matting, mounting, points, hangers, glue, tape, wires, D-rings, eyelets, backing, wall bumpers, etc. These myriad elements add to typical framing expenses, especially when archival materials are involved, and are often out-of-step with the aesthetics of contemporary artwork. Another typical drawback of common wall framing techniques is that they are permanent, and do not allow for easy updating and rotating of framed art. Most existing frames allow for only frontal viewing.

SUMMARY OF THE INVENTION

This invention reduces all of the complexity of traditional frames to as few as two interlocking, easily reopened, largely transparent panels with a distinct design and appearance. Rather than referring primarily to antecedents from historical techniques for framing fine art, this invention adapts packaging techniques from other arts (music, literature, and film) and applies them to the visual arts, allowing for a cost-effective, high-visual-impact display system that is ready to hang, can present useful documentation, and can provide archival quality storage. Objectives of this invention are to create a display frame that is simple, two-sided, distinct in appearance, ready to hang, and easy to replace its contents.

DETAILED DESCRIPTION OF THE PREFERRED EMBODIMENTS

While the present invention can be embodied in various forms, the figures shown here portray preferred embodiments of the invention with the understanding that the present disclosure is to be considered exemplary, but not intended to limit the invention to the specific embodiments illustrated.

Figure 1:
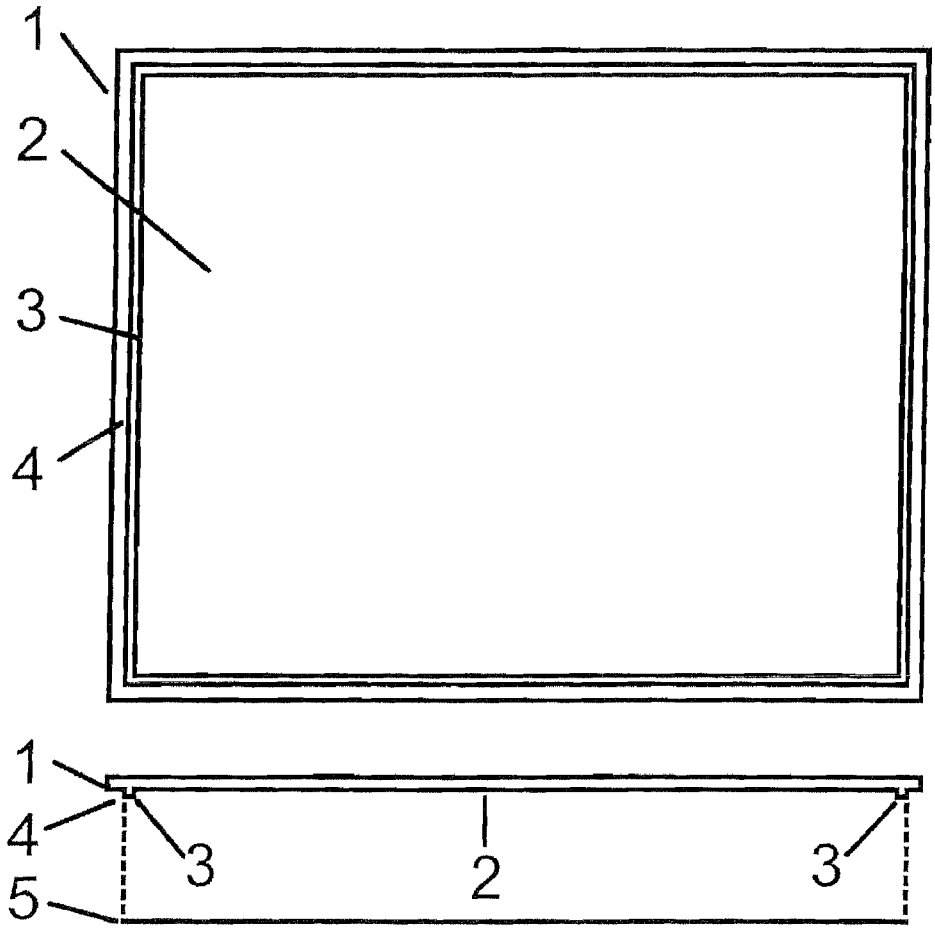
FIG. 1 is of a front panel, including frontal and cross-sectional views.

FIG. 1 shows frontal and cross-sectional views of the front panel 1, and illustrates how front-facing content 5 fits under the panel. All of the features of this preferred embodiment are made from injection-molded plastic, so that each panel is all of one piece. The front-facing content 5 can be any two-dimensional content, including images, documents, etc. The front panel 1 is one solid piece that includes a front glazing 2, an inner friction clamp 3, and an outer perimeter 4. The front glazing 2 is transparent, making the front-facing content 5 visible. The inner friction clamp 3 serves three functions of securing the front panel 1 to the back panel 6 in FIG. 2, holding the front-facing content 5 in place, and providing a space that separates the front-facing content 5 from the front glazing 2. The side of inner friction clamp 3 that faces the content 5 can be either smooth or textured to provide an illusion that the edge of the front-facing content 5 is deckled or otherwise textured. The outer perimeter 4 of the front panel 1 is flush with the front glazing 2. The outer perimeter 4 provides an illusion of molding. If the outer perimeter 4 is transparent, it allows for an illusion that the front-facing content 5 is floating.

Figure 2:
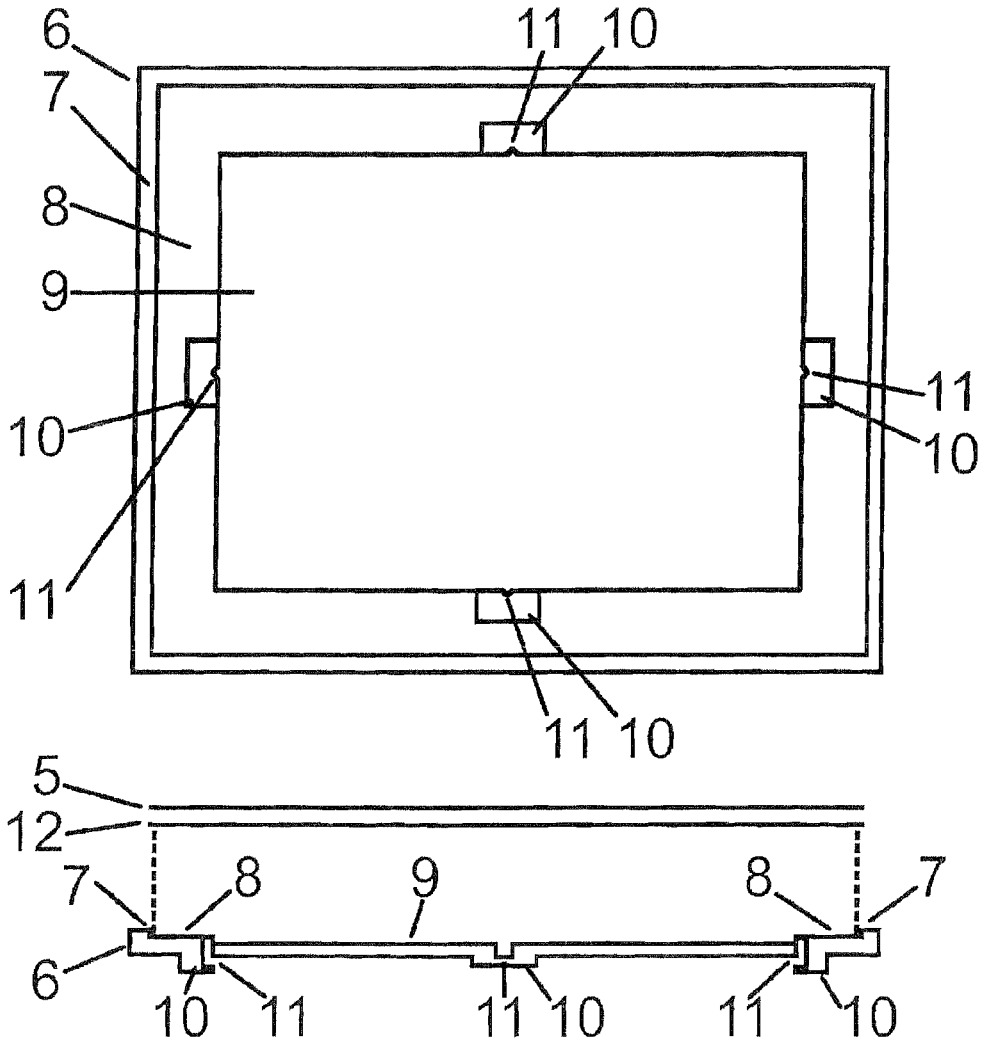
FIG. 2 is of a back panel, including rear and cross-sectional views.

FIG. 2 shows rear and cross-sectional views of the back panel 6, and illustrates how contents 5 and back-facing contents 12 fit on the back panel 6. The back-facing content 12 can be artwork or documents for viewing from the back of the frame. The back panel 6 is one solid piece that includes an outer friction clamp 7, a middle ledge 8, a back glazing 9, and four hanging-bumper devices 10. The inner friction clamp 3 of the front panel 1 illustrated in FIG. 1 secures into the outer friction clamp 7. The contents 5 and 12 rest on the middle ledge 8, which can be opaque or transparent. The middle ledge 8 also provides a space that separates the back-facing content 12 from the back glazing 9. The back glazing 9 is transparent, making the back-facing content 12 visible. Four hanging-bumper devices 10 are centered on each dimension of the frame outside of the exterior perimeter of the back glazing 9 to not block the viewing of the back-facing content 12. The hanging-bumper devices 10 allow the frame to be hung in any of four orientations from a wall using a standard picture hook or nail. The hanging-bumper devices 10 have a hanging-bumper-device slot 11, as shown in greater detail in FIG. 21. The display frame is hung from the upper-most hanging-bumper device 10, depending on the orientation of the front-facing content 5. To hang the display frame, the hanging-bumper-device slot 11 of the upper-most hanging-bumper device 10 is placed onto the end of a nail or hook that protrudes from a wall. The hanging-bumper devices 10 also create a space between the wall and the frame to reduce the potential for mold growth, condensation, insect infestation, and dust collection. As a result, the hanging-bumper devices 10 eliminate the need for bumpers, which are commonly placed at the bottom of a display frame to prevent the frame from being in direct contact with the wall.

Figure 3:
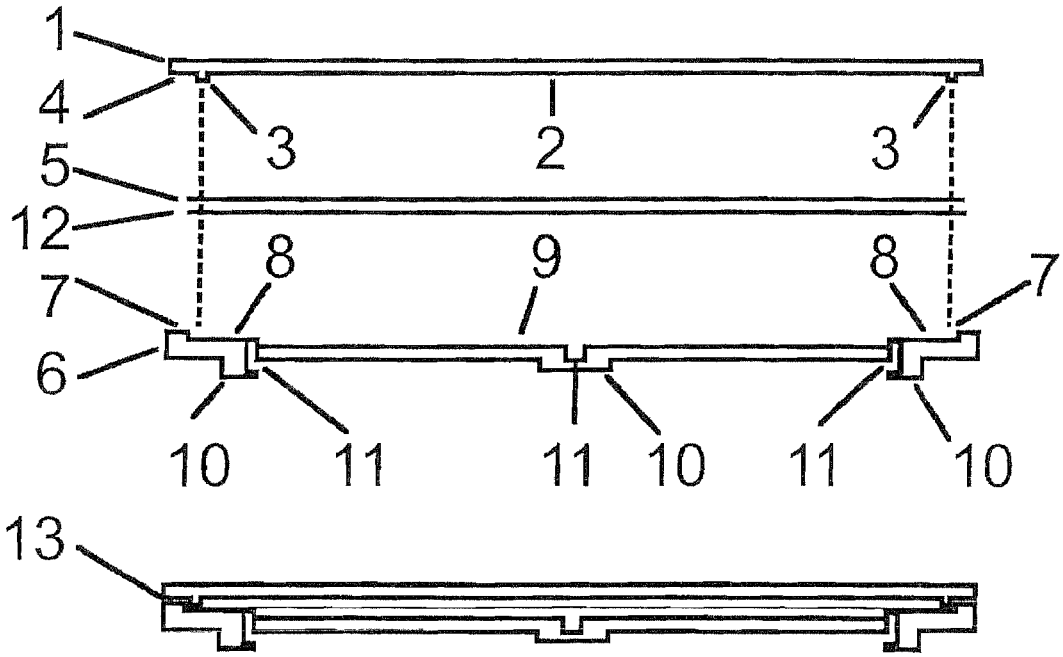
FIG. 3 is of a two-panel frame, including unassembled and assembled cross-sectional views.

FIG. 3 shows cross-sectional views of how the front panel 1, the back panel 6, and the contents 5 and 12 are assembled and ready to hang as a single unit. The display frame is easily assembled in the following manner. First, the back panel 6 is placed face-up on a horizontal surface. Then, the back-facing content 12 is placed face-down onto the middle ledge 8 so that all four corners of the content 12 fit within the outer friction clamp 7. Then, the front-facing content 5 is placed face-up directly on top of the back-facing content 12. Then, the front panel 1 is centered face-up on top of the back panel 6 and gentle pressure is applied so that the inner friction clamp 3 is secured into the outer friction clamp 7, thereby forming assembled two-panel frame 13.

Figure 4:
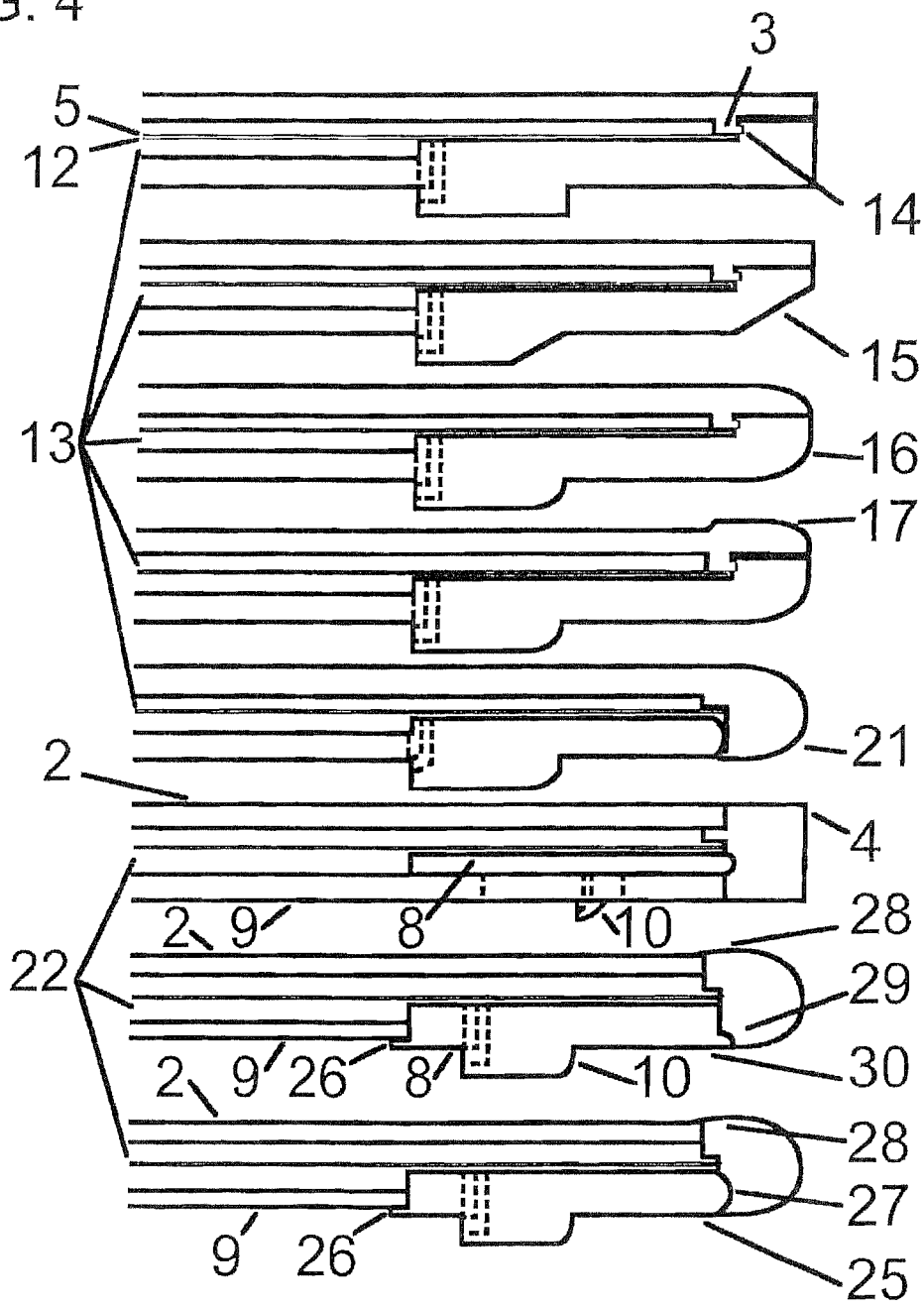
FIG. 4 is of sample panel frame variations, including enlarged cross-sectional views of a section of two- and four-piece assemblies.

The enlarged section of the assembled two-panel frame 13 illustrated in FIG. 4 shows how the inner friction clamp 3 touches the front-facing content 5 along its edges with minimum pressure to allow shrinkage and expansion with changing temperature and humidity, and to maintain overall archival quality storage. The pressure between inner friction clamp 3 and outer friction clamp 7 holds the front panel 1 and the back panel 6 together to create the assembled two-panel frame 13. Finally, the assembled frame 13 is lifted vertically and oriented properly depending upon the orientation of the front-facing content 5, and hung using the uppermost hanging-bumper device 10 at that orientation. To open the assembled frame 13, or to remove or exchange the contents 5 or 12, simply reverse this process by taking the assembled frame 13 off the wall, placing it onto a horizontal surface, separating the panels 1 and 6 using one's fingers along the edge of the display frame, and proceeding as above.

FIG. 4 shows that the assembled two-panel frame 13 can have a squared outermost edge, beveled outermost edge 15, rounded outermost edge 16, or any other shape or texture or combination thereof for its outermost edge. The thickness of each feature and the entire thickness of the assembled frame 13 can differ in various models of the frame. FIG. 4 illustrates how there can be an additional thickness or layer 17 over the outer perimeter 4 and the inner friction clamp 3 on the surface of the front panel 1 in order to enhance the three-dimensional illusion of traditional molding and to hide any sink mark that may be caused by the extra thickness of the inner friction clamp 3. The inner edge of this additional thickness, which would be aligned with the inner edge of the inner friction clamp 3 can be curved or squared or any other shape.

The method for securing the inner friction clamp 3 to the outer friction clamp 7 can vary. FIG. 4 shows how an undercut snap fit 14 can be used to provide additional, but barely visible means to secure the front and back panels 1 and 6. The undercut snap fit 14 is a small bead or lip protruding around the entire rear-most outside corner of the inner friction clamp 3, which snaps or zips into an equivalently sized groove on the interior side of the outer friction clamp 7. The front and back panels 1 and 6 can be entirely separate or joined and hinged along one edge. The front and back panels 1 and 6 can slide into each other using grooved tracking, glides or channels. Various additional devices can be used to secure panels 1 and 6 to each other, including clips, latches, tethers, bands, magnets, flexible membranes, elastic bands, cords, lips, pins, snaps, bolts or other features.

FIG. 4 illustrates how the functionality of the assembled two-panel frame 13 can be reversed, wherein the back panel 6 snaps into the front panel 1 rather than vice versa, as illustrated by the overhang function clamp 21. FIG. 4 also provides enlarged cross-sectional views of variations of a four-piece assembled panel frame 22. The foul-piece frame includes separate components for the front glazing 2, outer perimeter 4, middle ledge 8, and back glazing 9. The front glazing 2 can be glued, welded or otherwise affixed to the outer perimeter 4, and the back glazing 9 can be similarly affixed to the middle ledge 8, so that the final product can appear to the end user as two pieces.

Figure 5:
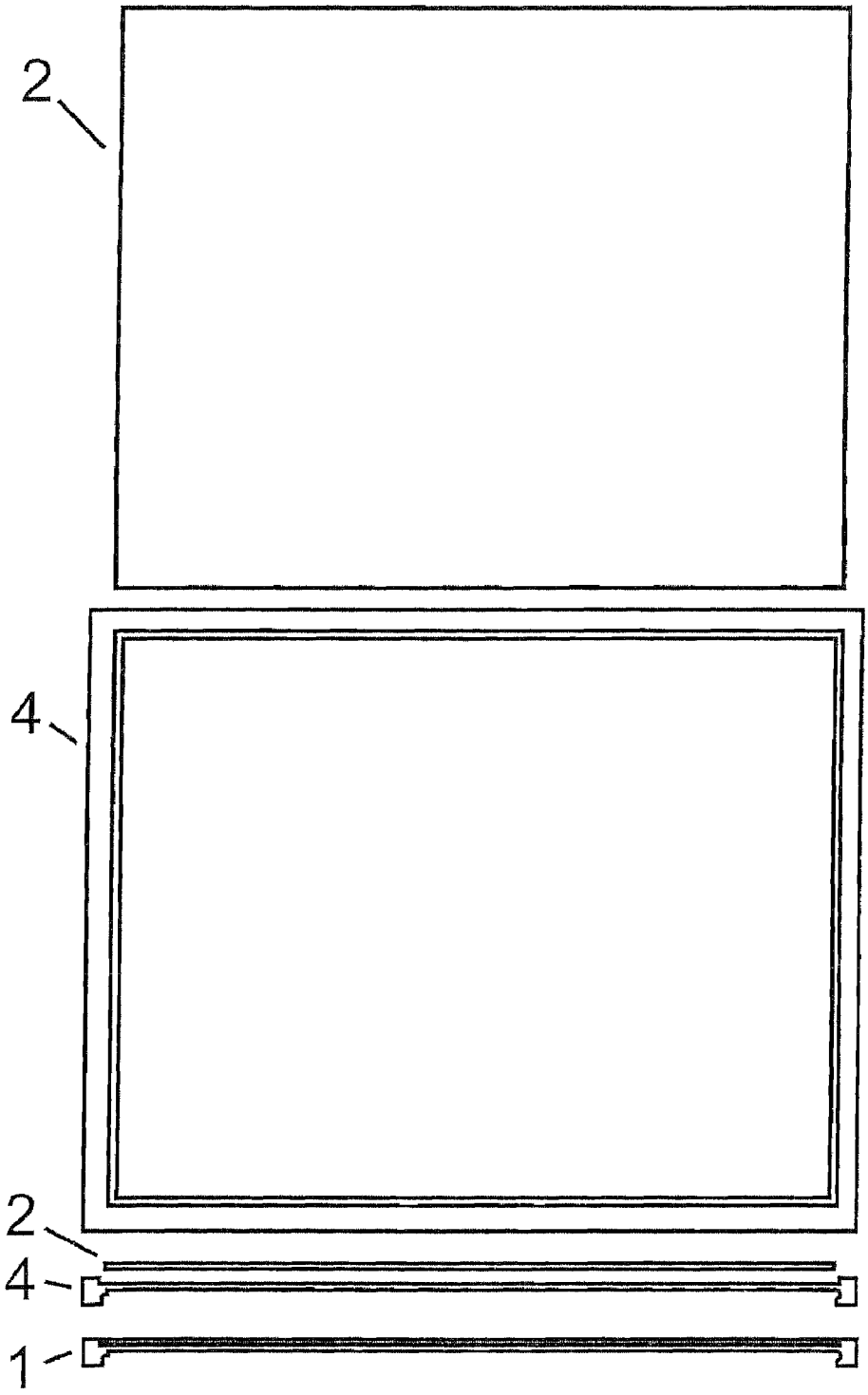
FIG. 5 is of a front panel and glazing for a four-piece assembly, including frontal and cross-sectional views.
Figure 6:
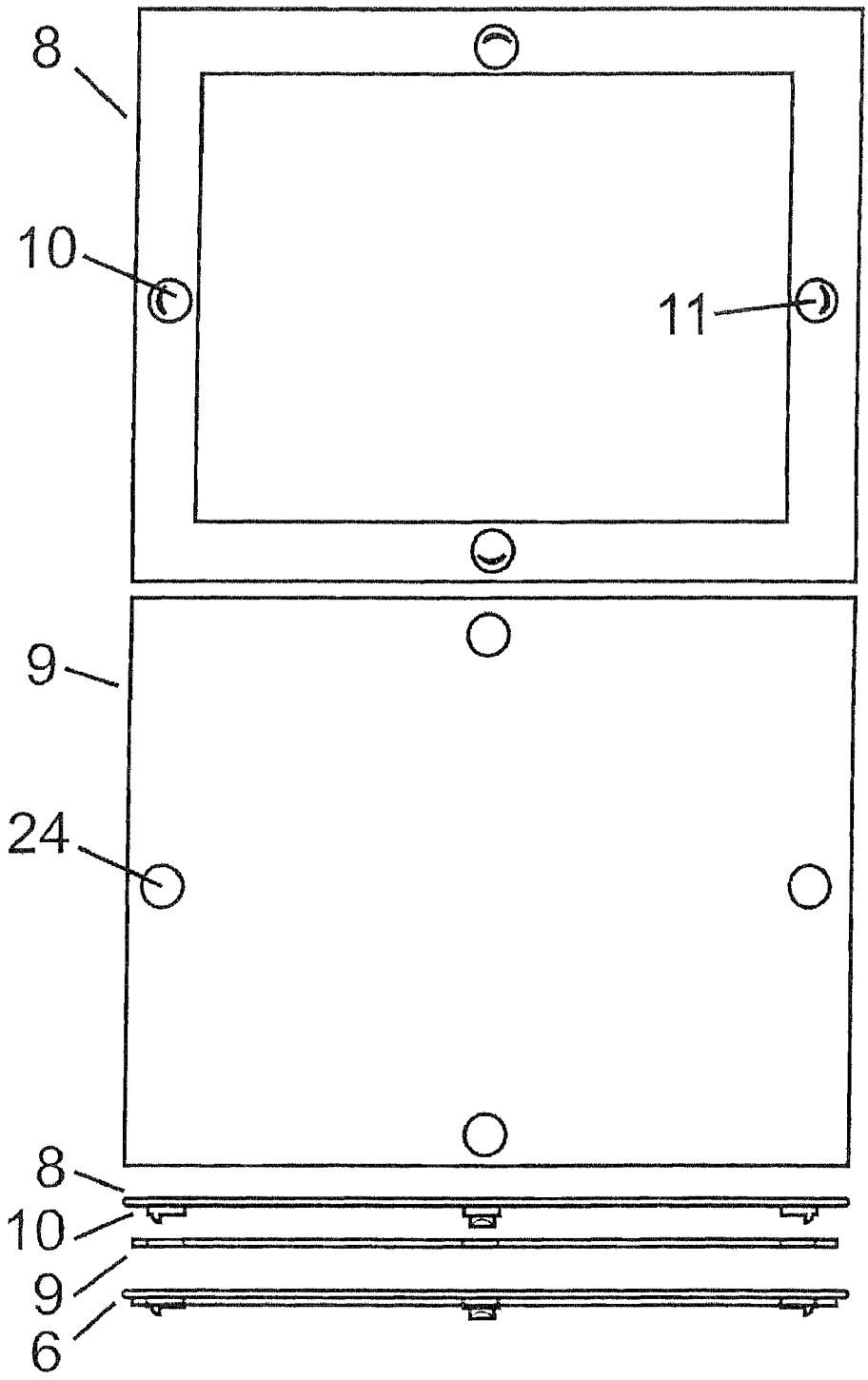
FIG. 6 is of a back panel and middle ledge for a four-piece assembly, including frontal and cross-sectional views.
Figure 7:
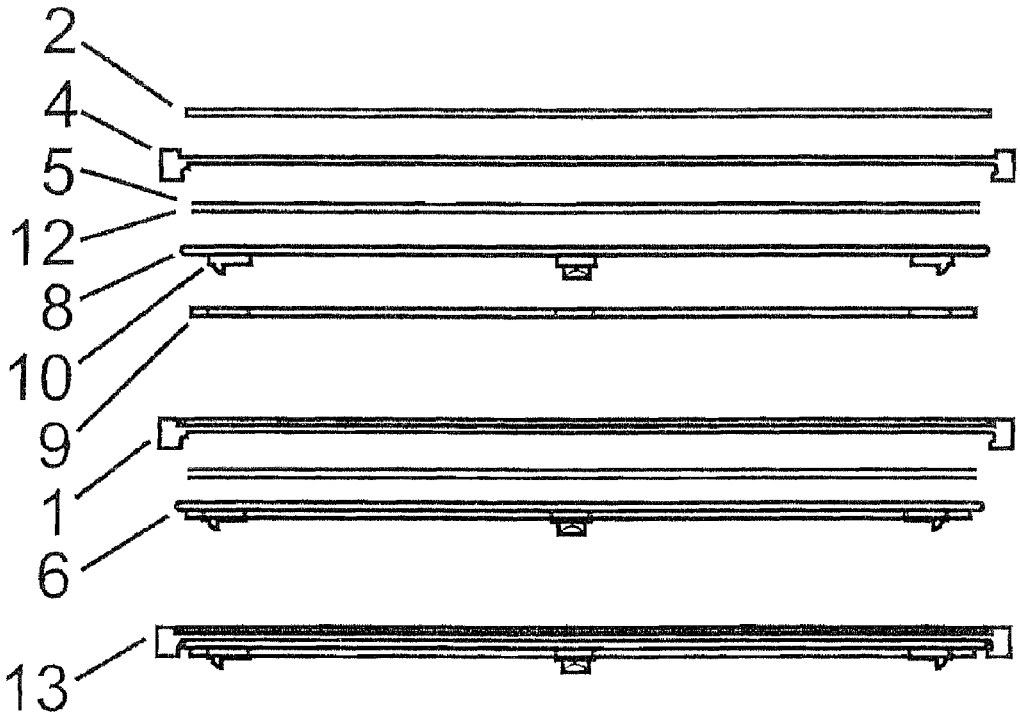
FIG. 7 is of a four-piece panel frame, including cross-sectional, unassembled and assembled views.

FIG. 5, FIG. 6, and FIG. 7 provide more detail to the four-piece panel frame 22 that is illustrated in the enlarged cross-section in FIG. 4. In this four-piece panel frame, the front and back glazings 2 and 9 are on the outside of the frame, enabling flush front and back surfaces, except for the protrusion of the hanging-bumper devices. In this version, the front and back glazings 2 and 9 can be made from pre-fabricated plastic or glass or other transparent sheeting. FIG. 5 shows the two parts of the front panel 1, which include standard-sheet front glazing 2 that is glued or otherwise affixed to injection-molded, cast, extruded or otherwise manufactured outer-perimeter 4. FIG. 6 shows the middle-ledge 8, which in this version is a separate piece of molded material that incorporates the hanging-bumper devices 10 and slots 11, and does not need to be transparent, as well as the back glazing 9, which is a transparent, flat glazing sheet with four hanging-bumper-device holes 24 cut into it. The middle ledge 8 and back glazing 9 can be affixed together to form the back panel 6, or can be held together by the pressure of the hanging-bumper devices 10 on the hanging-bumper-device holes 24 if the hanging-bumper devices 10 are slightly angled or offset. FIG. 7 shows how the four pieces fit together, along with the front- and back-facing contents 5 and 12. The hanging-bumper devices 10 also serve as finger holds to pop the back panel 6 into and out of the front panel 1.

Figure 8:
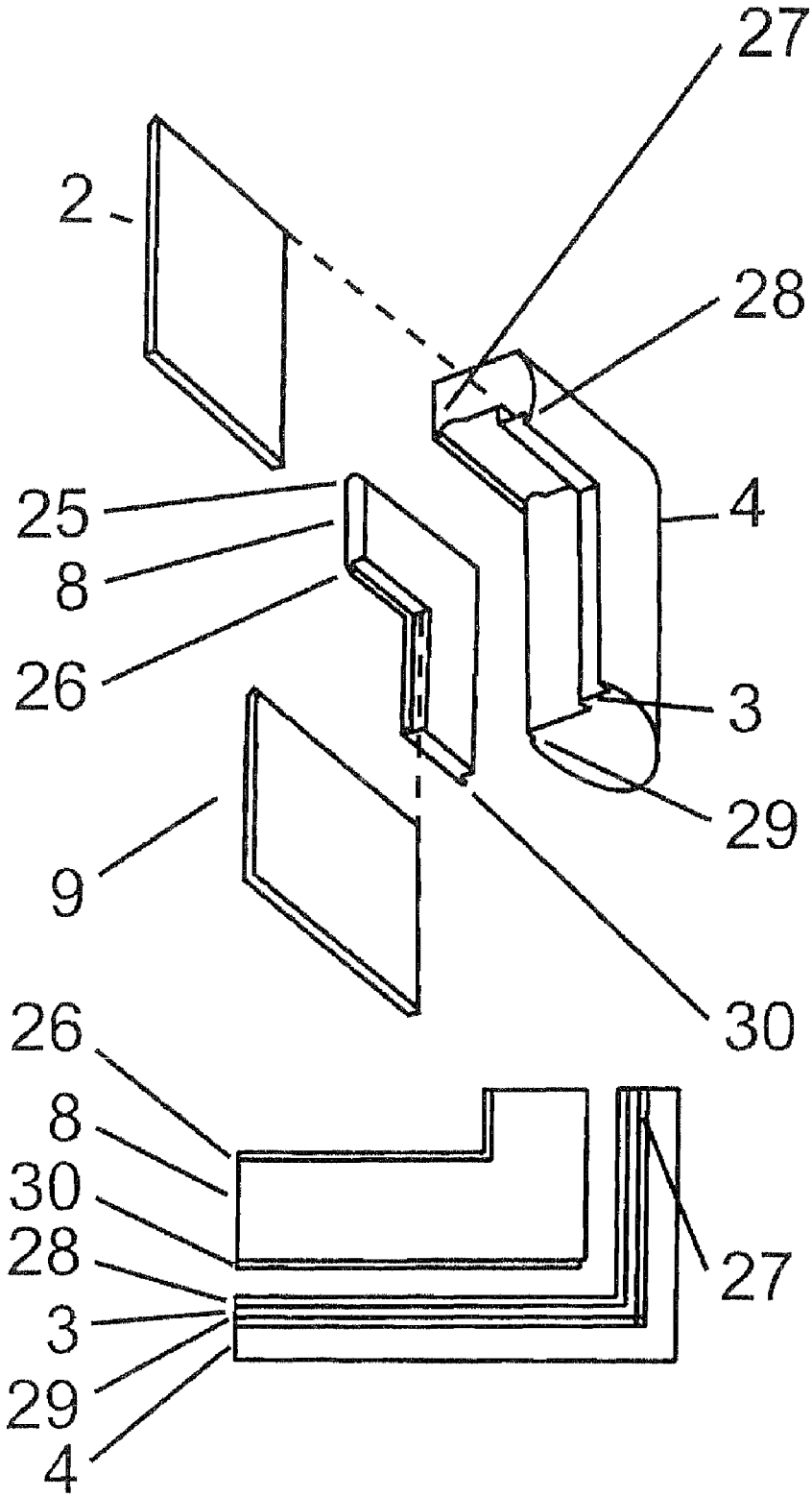
FIG. 8 is of a four-piece panel frame, including exploded and frontal views of a section.

FIG. 8 shows partial exploded and frontal views of a four-piece panel frame variation where the front and back glazings 2 and 9 are held in place by external lips 26 and 28, creating front and back surfaces that are not flush, unlike the version shown in FIGS. 5, 6, and 7, but rather create an elevated outer perimeter 4 that resembles traditional display frame molding in appearance. The front glazing 2 and back glazing 9 are separate sheets of clear plastic, glass, or other transparent sheeting that are glued or otherwise affixed to the front- and back-glazing lips, 28 and 26 respectively. The front panel 1 is created by joining the front glazing 2 to the outer perimeter 4 at the front-glazing lip 28. The back panel 6 is created by joining the back glazing 9 to the middle ledge 8 at the back-glazing lip 26. The assembled front panel 1 and assembled back panel 6 appear and function like traditional moldings during manufacture, because in this variation the glazings are attached as part of an assembly process to form the two panels. The short rounded end 25 of the middle ledge 8 fits into the slight inner groove 27 in the outer perimeter 4. The middle-ledge outer lip 30 presses onto the outer groove 29 of the outer perimeter 4. The contrary pressures of these fittings secure the assembled back panel 6 into the assembled front panel 1. The hanging slots 11, which are not shown in FIG. 8, on the middle ledge 8 double as finger holds for pulling the assembled back panel 6 out of the assembled front panel 1. To fit the back panel 6 into the front panel 1, one of the short rounded ends 25 is put into the inner groove 27 of the assembled front panel 1, and then the assembled back panel 6 can be bent slightly so that its other short rounded end 25 can be placed into the inner groove 27 on the other end of the assembled front panel 1. The partial frontal view in the lower portion of FIG. 8 shows four parallel lines that follow the contour of the front-facing content 5 are visible. These four visible rectangular lines are in contrast to the two visible rectangular lines created by the inner friction clamp 3 of the one-piece version of the front panel 1 as illustrated in FIG. 1. These four visible rectangular lines are created by two features that are in front of the front-facing content 5, including the front glazing lip 28 and inner friction clamp 3, which holds the front-facing content 5 in place, and two features that are in back of the front facing content 5, but also slightly larger in dimension and hence visible, including inner groove 27 on the shorter end of the outer perimeter 4 and outer groove 29 on the longer end of the outer perimeter 4.

The entire invention can be produced using a wide variety of materials, methods, colors, textures, sizes, patterns and shapes. For example, the entire frame can be molded as two pieces in archival, acid-free, ultra-violet-light-protected acrylic. The outer perimeter 4, outer friction clamp 7, and middle ledge 8 can be cast in metal or other materials, while only the glazing windows 2 and 9 are made from a transparent content. If other or multiple materials are used instead of injection molding, then the various elements could need to be glued or otherwise joined together. This invention can be used to frame any kind, size, thickness, shape, or material of two-dimensional or relief work, ranging from small snapshots to large works of several square feet in area, and is particularly well-suited for inkjet prints, because the front and back glazing 2 and 9 do not touch the ink within sizeable windows. Single or multiple contents such as 5 and 12, and even additional layers can be held within the frame. The gap between the inner friction clamp 3 and the middle ledge 8 can vary in thickness to accommodate different thicknesses of contents. The middle ledge 8 can be of different widths to accommodate various sizes of back-facing content 12.

Figure 9:
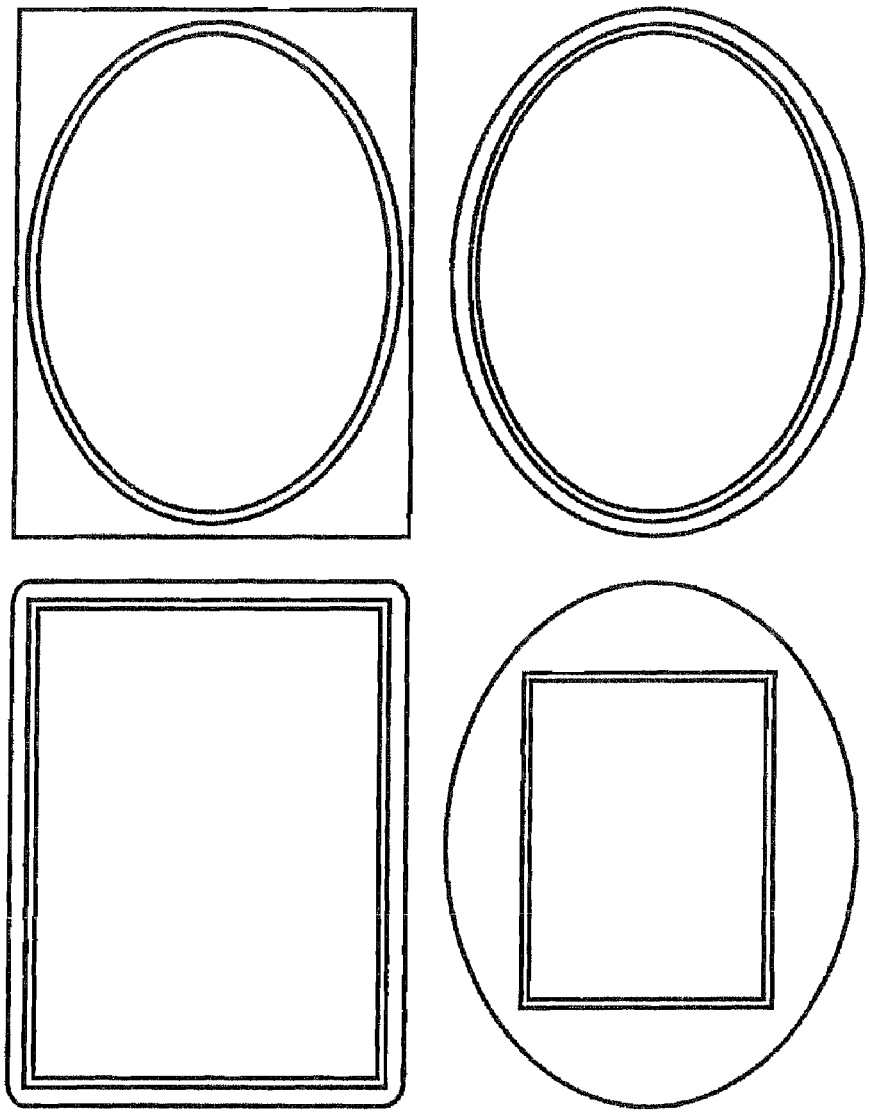
FIG. 9 is of sample frame shape variations, including frontal views.

In order for the visibility of the contents 5 and 12 and illusion of float, the entire frame can be made of transparent materials, and a frosted or opaque finish can be applied to the rear-most outside surface of the back panel 6, extending from the edge of the frame to the interior edge of the middle ledge 8, including or not including the hanging-bumper devices 10. Such finishing can provide the dramatic illusion of a frame in any range of colors, patters, textures, widths and depths. Traditional molding can also be attached to the assembled frame 13. The different features of the frame can be of different shapes, textures and materials. For example, FIG. 9 illustrates how the outer edges of the outer perimeter 4 and outer friction clamp 7 could be round, ovular, wavy, or any other shape, while the front and back glazing 2 and 9 as well as the inner edge of the friction clamps 3 and 7 could be rectangular, or vice versa. The surface of the front panel 1 can be flat or curved to create lenses or magnification effects.

Figure 10:
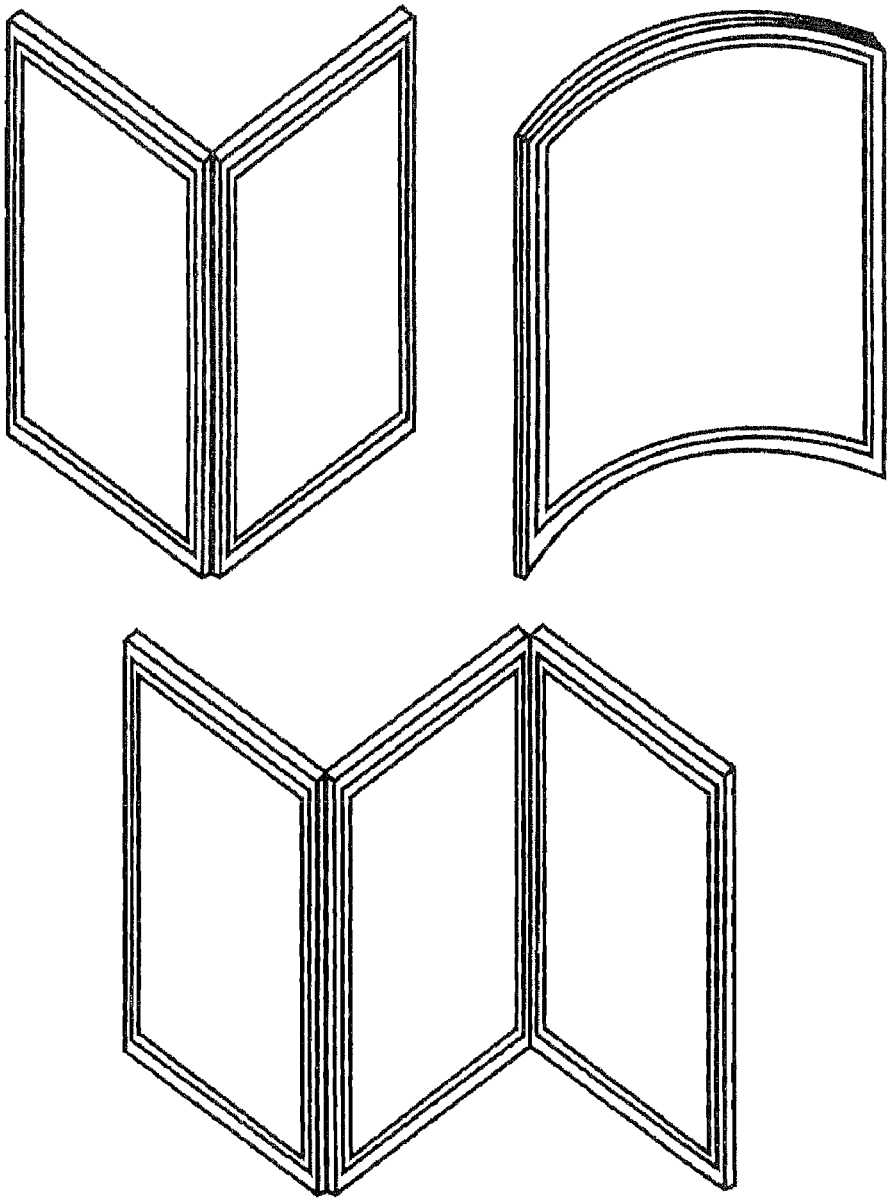
FIG. 10 is of sample standing frame configurations, including three-dimensional views.

FIG. 10 shows variations of how the frame can also be manufactured without hanging-bumper devices 10, but rather can be configured for standing on a table top or other horizontal surface. For example, the front and back panels 1 and 6 could have a curvature along a single axis, enabling the assembled frame 13 to stand on either of two ends. Multiple front and back panels 1 and 6 could be joined and hinged along one edge to create an angled version of a multi-panel, two-sided standing frame. A variety of mechanisms can be used to join any number of frames, including a strip of flexible material or hinge or other device.

Figure 11:
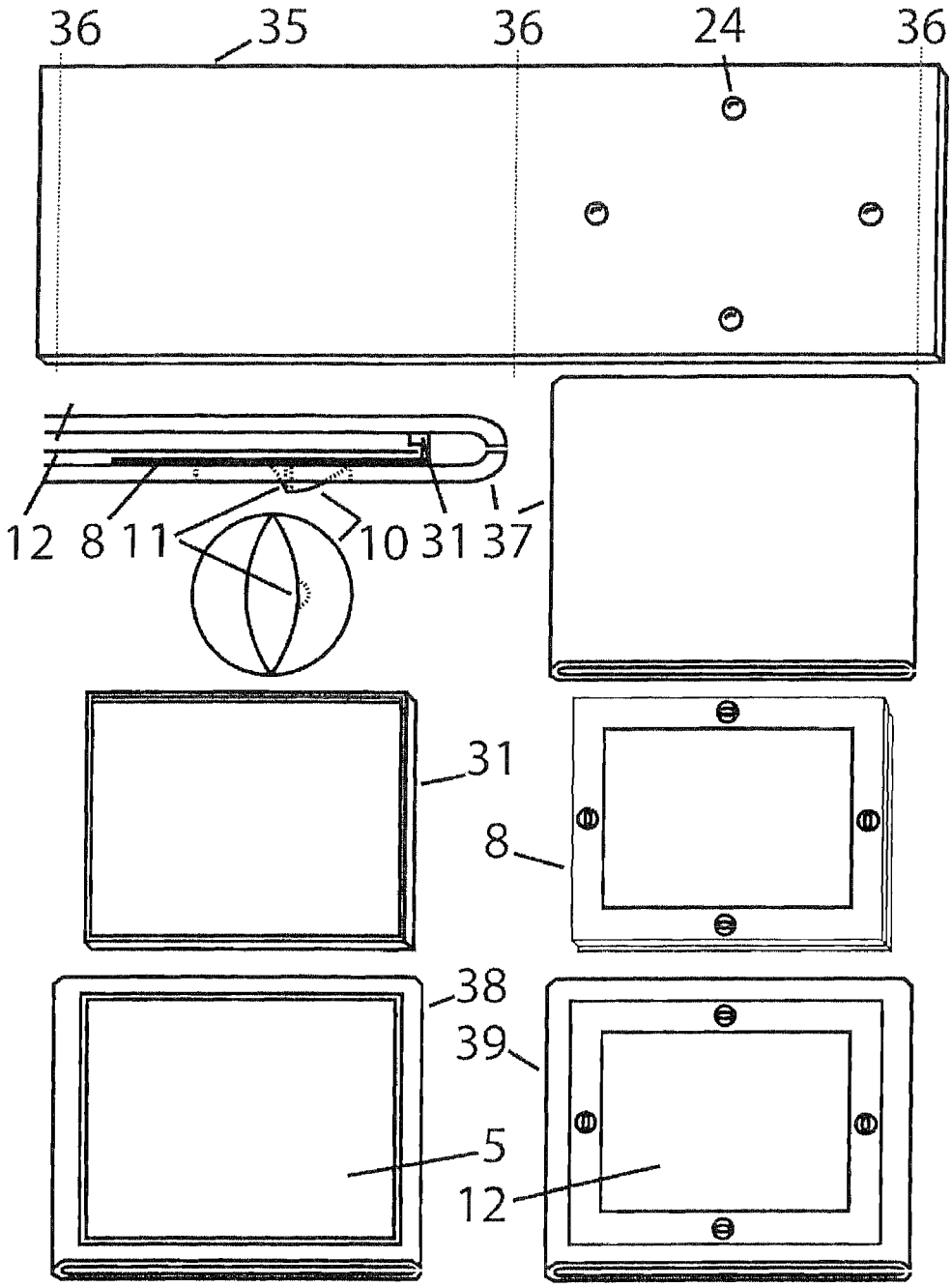
FIG. 11 is of a three-piece folded frame, including an unfolded, folded, unassembled, assembled, frontal, rear, and enlarged cross-sectional views.
Figure 16:
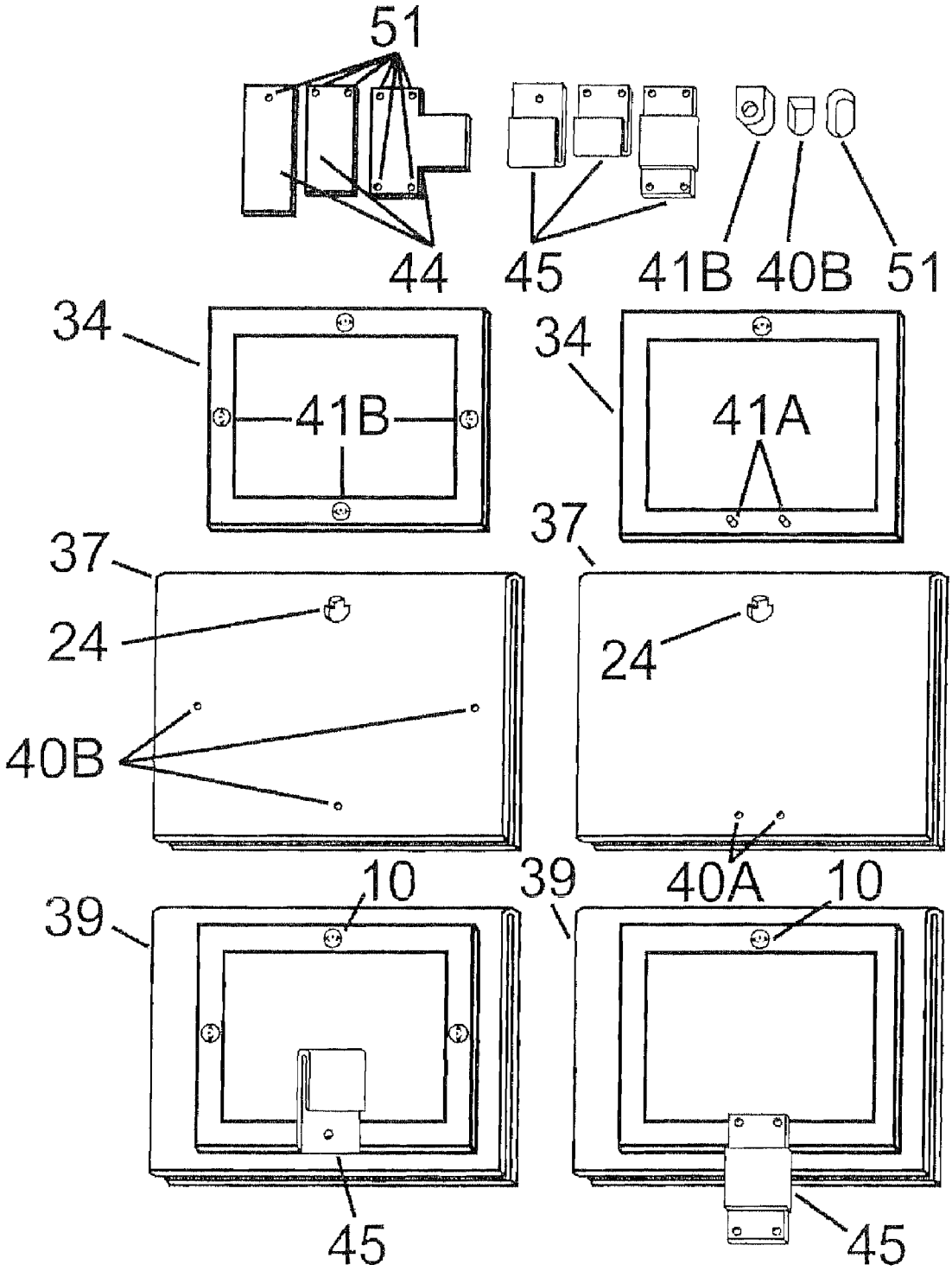
FIG. 16 is of sample label-holder variations, including views of unfolded and folded label holders and rear views of folded outer glazings and inside assemblies.

FIG. 11 illustrates a sample three-piece folded frame 23, including the outer glazing 35, front spacer 31, and middle ledge 8. FIG. 11 shows the shape of one variation of an unfolded outer glazing 35, which is folded along folding line 36 to form the folded outer glazing 37. The rectangular outer glazing 35 can be folded along the shorter width of the rectangle as illustrated in FIG. 11 or along the longer length of the rectangle. Triangular, semicircular, and other shaped folded outer glazings are also possible. The back side of this sample folded outer glazing 37 has four hanging-bumper-device holes 24 that create a fixed position into which the hanging-bumper devices 10 can slide or be fastened. The rounded profile of this version of the hanging-bumper devices 10 facilitate the inside assembly 34 being snapped into place and held firmly by the folded outer glazing 37. The front spacer 31 and middle ledge 8 combine to form the inside assembly 34 (FIG. 16). The inside assembly 34 holds in place the front- and back-facing contents 5 and 12. FIG. 11 illustrates frontal and rear views 38 and 39 of the assembled three-piece frame with the front- and back-facing contents 5 and 12 in place.

Instead of being folded along one edge, the outer glazing can consist of two panels that are hinged, or that slide into each other using grooved tracking, glides or channels. Various additional devices can be used to secure the outer glazing to each other and to the inside assembly 34, including clips, latches, tethers, bands, magnets, flexible membranes, elastic bands, cords, lips, pins, snaps, bolts or other features.

Figure 12:
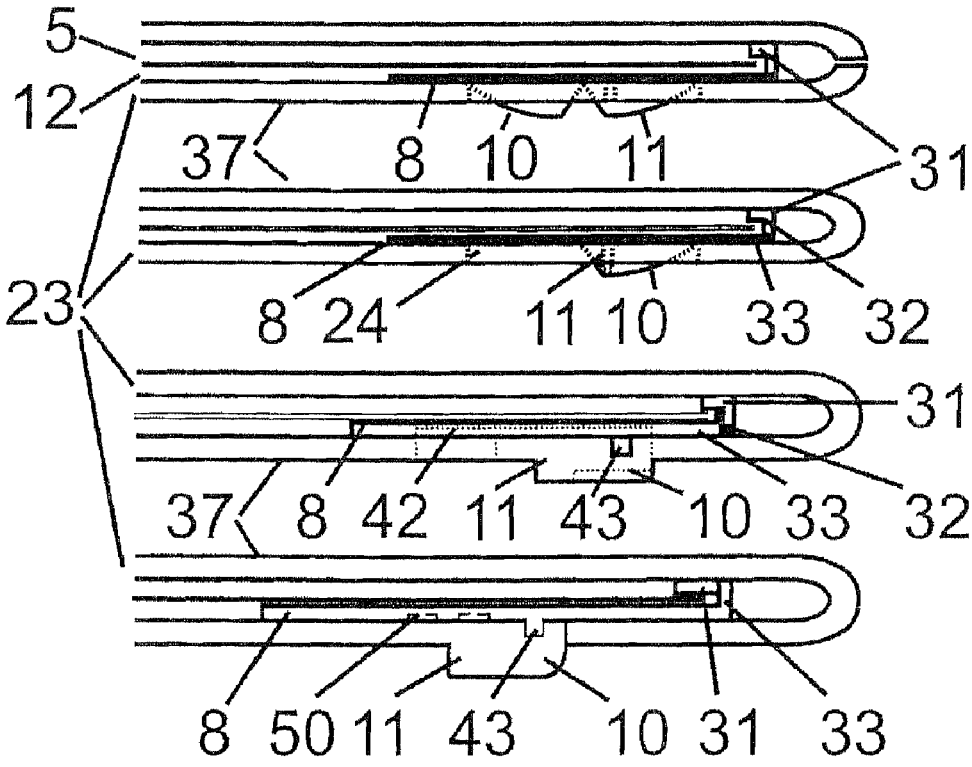
FIG. 12 is of sample folded frame variations, including enlarged cross-sectional views of a section.

FIG. 12 is of sample folded frame 23 variations, including enlarged cross-sectional views of a section. FIG. 12 illustrates various profiles of hanging-bumper devices 10 that can be attached or separate from the middle ledge 8. Independent hanging-bumper devices 10 can be glued or otherwise affixed to the folded outer glazing 37 using orientation notches 43 to ensure they are properly placed. FIG. 12 shows various configurations for joining the middle ledge 8 and front spacer 31, including various front-spacer and middle-ledge outer lips 32 and 33 that help secure the front spacer 31 to the middle ledge 8, and that create space for the front- and back-facing contents 5 and 12.

Figure 13:
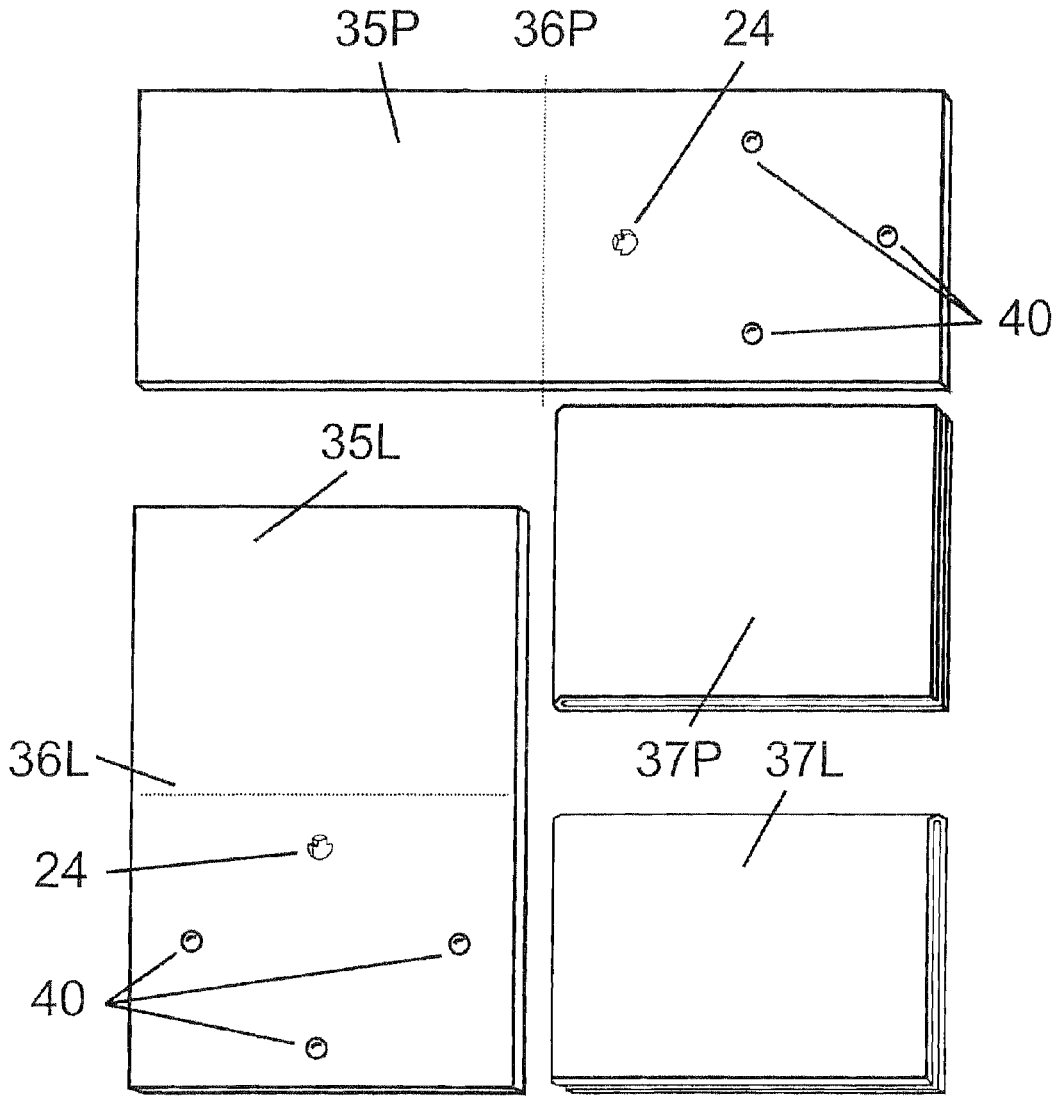
FIG. 13 is of sample outer-glazing variations, including unfolded and folded views.
Figure 14:
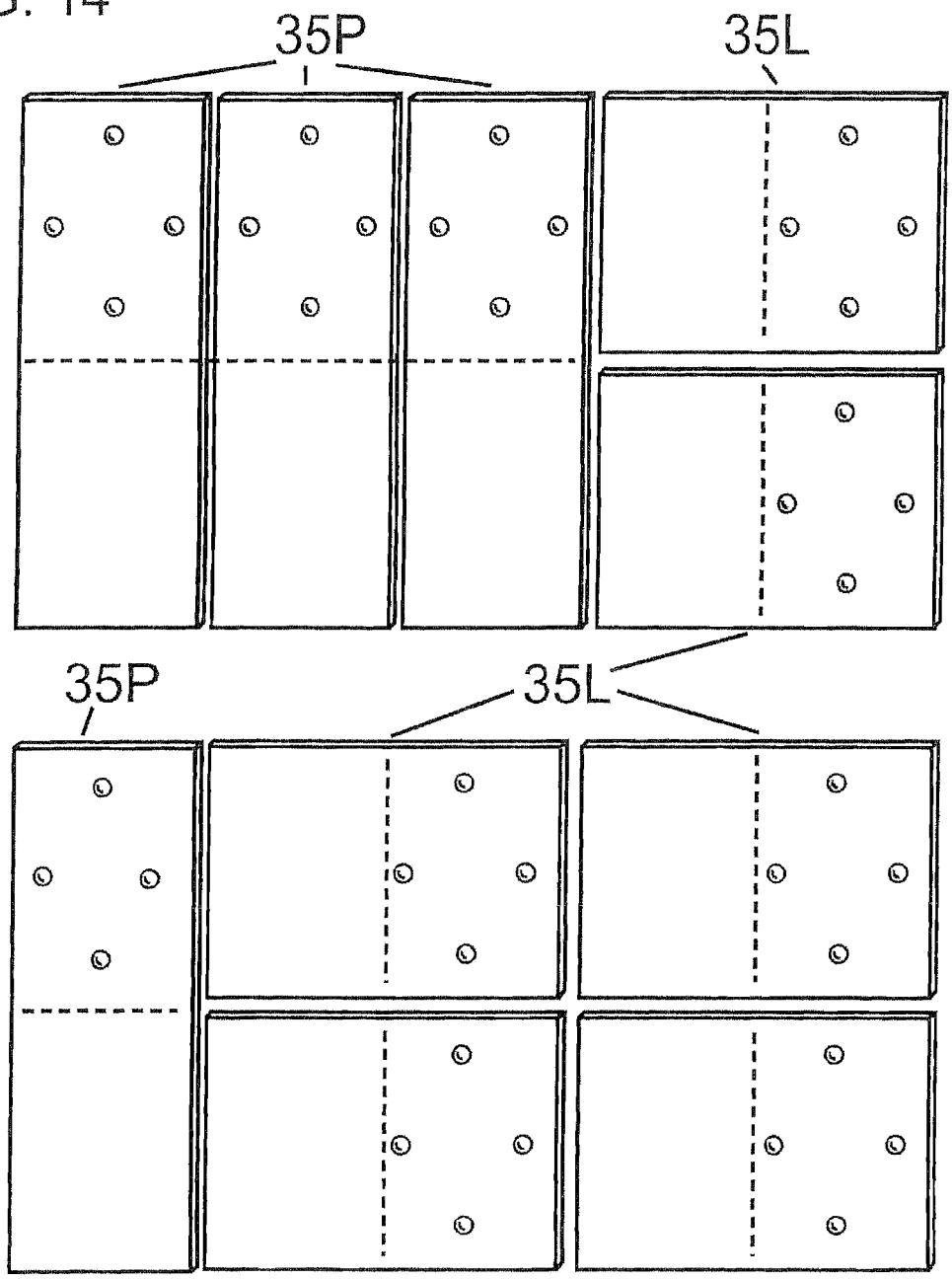
FIG. 14 is of unfolded outer-glazing configurations for cutting from a standard piece of sheet plastic.

FIG. 13 shows two variations of outer glazing 35, including unfolded and folded views. Outer glazing 35P when folded along fold line 36P creates a portrait-oriented folded outer glazing 37P wherein the vertical dimension is greater than the horizontal dimension. Outer glazing 35L when folded along fold line 36L creates a landscape-oriented folded outer glazing 37L wherein the horizontal dimension is greater than the vertical dimension. The folded frames 23 are hung with the fold lines 36 in the uppermost position to avoid dust, water, and other elements from coming into contact with the inside assembly 34 or with the front- and back-facing contents 5 and 12. FIG. 13 shows that the outer-glazing hanging-bumper-device hole 24 is always in the uppermost position, closest to the fold line 36 when a separate hanging-bumper device 10 is attached to the outer glazing 35. The three other holes on the back of the folded outer glazing 37 are the outer-glazing bumper holes 40. The three outer-glazing bumper holes 40 position the inside assembly 34 and allow the middle-ledge bumpers 41 to protrude from the back of the outer glazing to create a space between the folded outer glazing 37 and the hanging wall. Multiple unfolded portrait-oriented outer glazings 35P and unfolded landscape-oriented outer glazings 35L can be cut in different configurations from standard size sheets of plastic with little or no wasted material as illustrated in FIG. 14.

Figure 15:
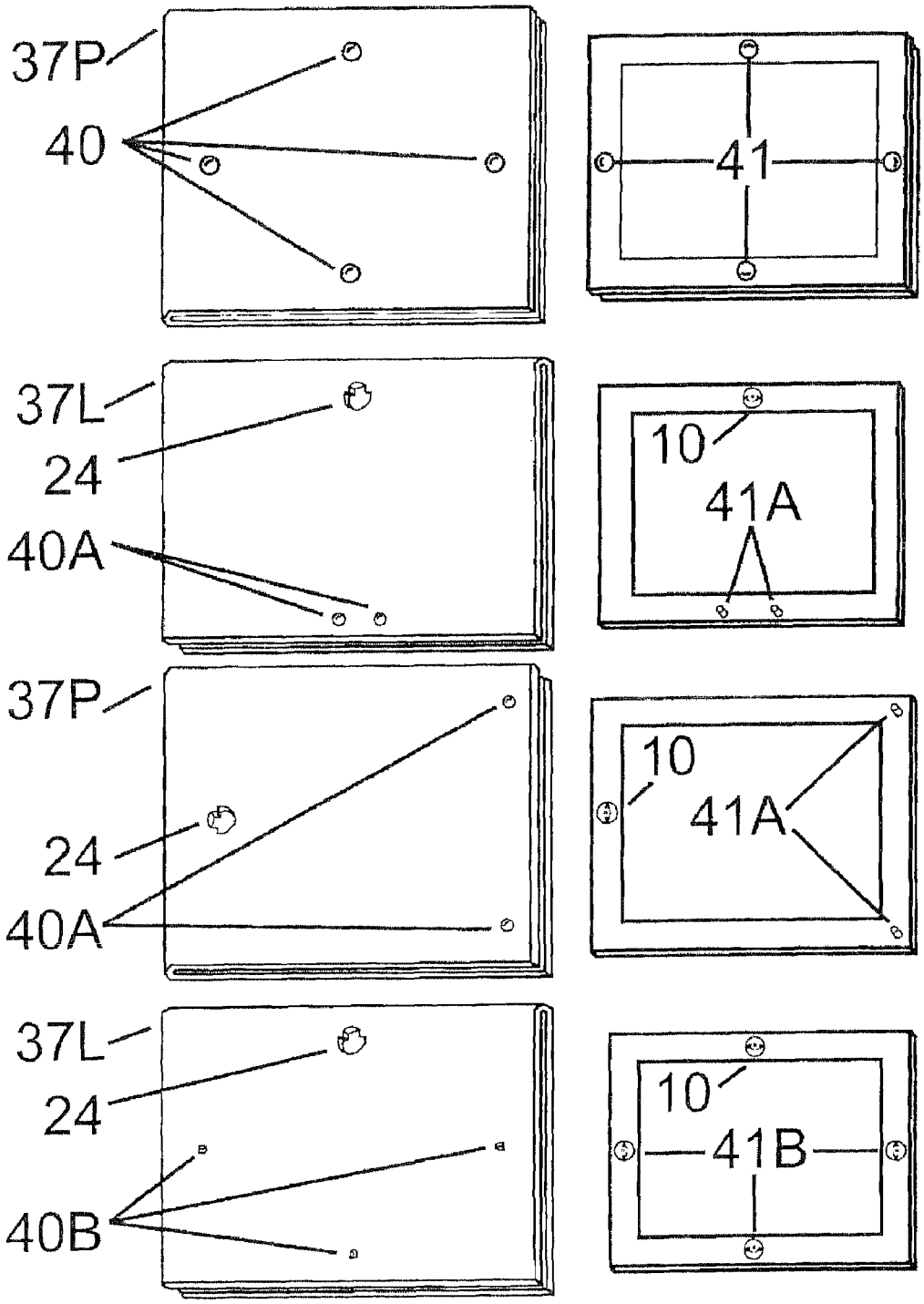
FIG. 15 is of sample bumper configurations, including rear views of folded outer glazings and inside assemblies.

FIG. 15 illustrates a sample variety of bumper configurations, including rear views of folded landscape- and portrait-oriented outer glazings 37L and 37P and middle ledges 8 with attached middle-ledge bumpers 41. The middle-ledge bumpers 41 and hanging-bumper devices 10 can be shaped identically and fit into identically shaped outer-glazing bumper holes 40. The middle-ledge bumpers 41 can also be shaped in any variety of ways differently from the hanging-bumper device 10, as in the examples of middle-ledge bumpers 41A and 41B, which fit into outer-glazing bumper holes 40A and 40B, respectively. When the middle-ledge bumpers 41 and hanging-bumper device 10 are shaped differently, an outer-glazing hanging-bumper-device hole 24 that is shaped differently from the outer-glazing bumper holes 40 is necessary. A folded frame 23 can have any number of middle-ledge bumpers 41 and outer-glazing bumper holes 40, and these features can be placed at various positions in the frame as illustrated in FIG. 15.

FIG. 16 illustrates sample folded label holder 45 frame accessories, including unfolded and folded frontal views, as well as rear views of unassembled inside assemblies 34 and folded outer glazings 37, and rear views of assembled folded frames 39. The label holder can be cut or molded or otherwise manufactured from a sheet of transparent material in multiple shapes and folded along any of several variations of label-holder fold lines 44. A label printed on paper or other material indicating the title, artist or other descriptions of the front-facing contents 5 can be inserted between the panels of the folded label holder 45. The folded label holder 45 can be hung from one or more middle-ledge bumpers 41 by inserting the bumper or bumpers into the label-holder hanging hole or holes 51. The middle-ledge bumpers 41 and label-holder hanging holes 51 can be shaped and configured so that the folded label holder can be contained within the dimensions of the folded frame 23 for shipping, either within or outside of the folded outer glazing 37, or hung from the bottom or other middle-ledge bumpers 41, or hung directly onto a wall.

Figure 17:
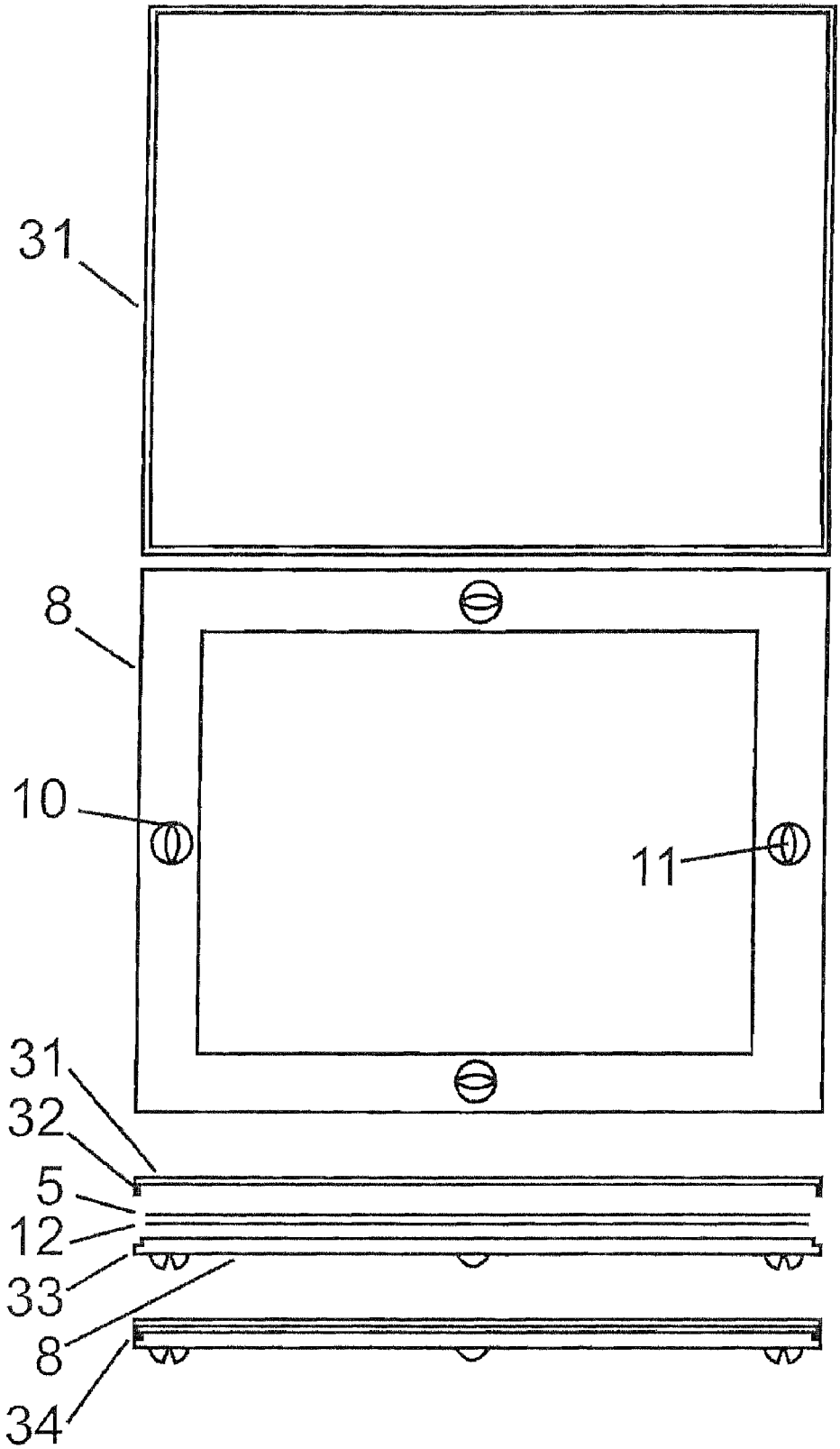
FIG. 17 is of an inside assembly for a folded frame, including unassembled frontal, rear and cross-sectional views, and an assembled cross-sectional view.

FIG. 17 shows frontal, rear, cross-sectional, and assembled views of the inside assembly 34 of a folded frame 23. The inside assembly 34 is made up of a front spacer 31 and middle ledge 8. The front spacer 31 separates the front-facing content 5 from the outer glazing 35. The front spacer 31 is secured to the middle ledge 8 by the front-spacer outer lip 32 that fits onto a middle-ledge outer lip 33. The front- and back-facing contents 5 and 12 are secured within this inside assembly 34, which is inserted between the folded outer glazing 37 as illustrated in FIG. 14. The front spacer 31 can be secured to the middle ledge 8 by a wide variety of interlocking configurations involving dovetails, lips, walls, ledges, snaps, hooks, sliding channels, and other function or displacement arrangements.

Figure 18:
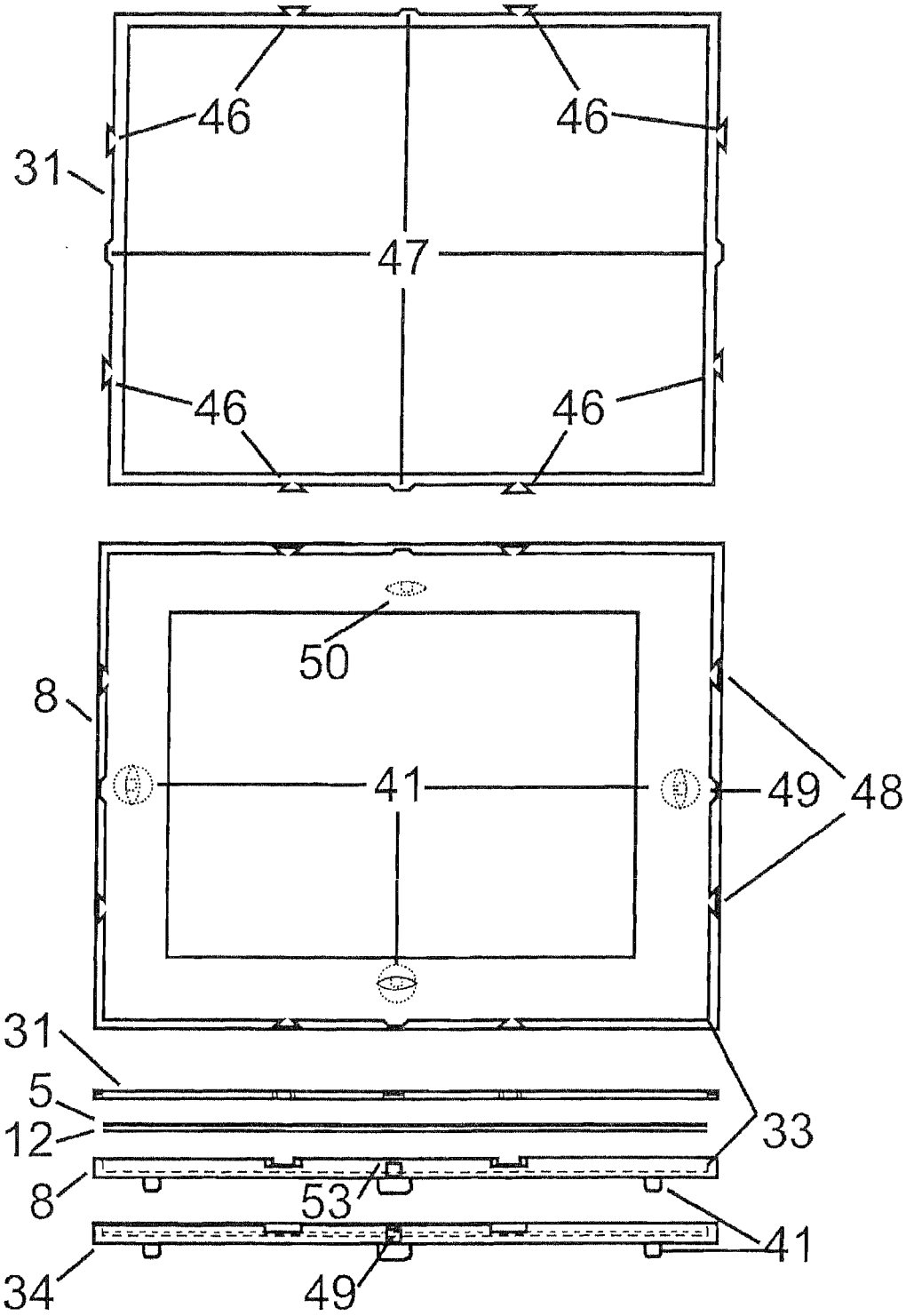
FIG. 18 is of a dove-tailed inside assembly for a folded frame, including unassembled frontal, rear and cross-sectional views, and an assembled cross-sectional view.

FIG. 18 is of a sample dove-tailed inside assembly 34 for a folded frame 23, including frontal, rear, unassembled, and assembled cross-sectional views. Dovetailing more securely holds the front- and back-facing contents 5 and 12 within the inside assembly 34 by more firmly attaching the front spacer 31 to the middle ledge 8 than does an arrangement including only outer lips 32 and 33 as illustrated in FIG. 17. The dovetail tabs 46 fit into dovetail slots 48 to prevent the front spacer 31 from drooping towards the center of the frame. The under-hold tabs 47 fit into the under-hold holes 49 to prevent the front spacer 31 and middle ledge 8 from separating when the inside assembly 34 is removed from the confines of the folded outer glazing 37. The under-hold-slot lip layer 53, which can be created using a cam or shut off, keeps the under-hold tab 47 in place. The under-holds and dovetails can be positioned anywhere around the perimeter of the inside-assembly 34 and can alternate in any order. The dovetail and under-hold tabs 46 and 47 and their corresponding holes 48 and 49 can be parts of either the front spacer 31 or middle ledge 8. The tabs 46 and 47 can be flush or raised from the surface of the front spacer 31 or middle ledge 8 in order to guide the placement of the front- and back-facing contents 5 and 12. FIG. 18 also illustrates a middle-ledge configuration that includes three middle-ledge bumpers 41 and an indentation 50 that is found in the location of where a separate hanging-bumper device 10 attaches to the outer glazing 35. FIG. 17, in contrast, shows four similarly shaped hanging-bumper devices 10 that are attached to the middle ledge 8.

Figure 19:
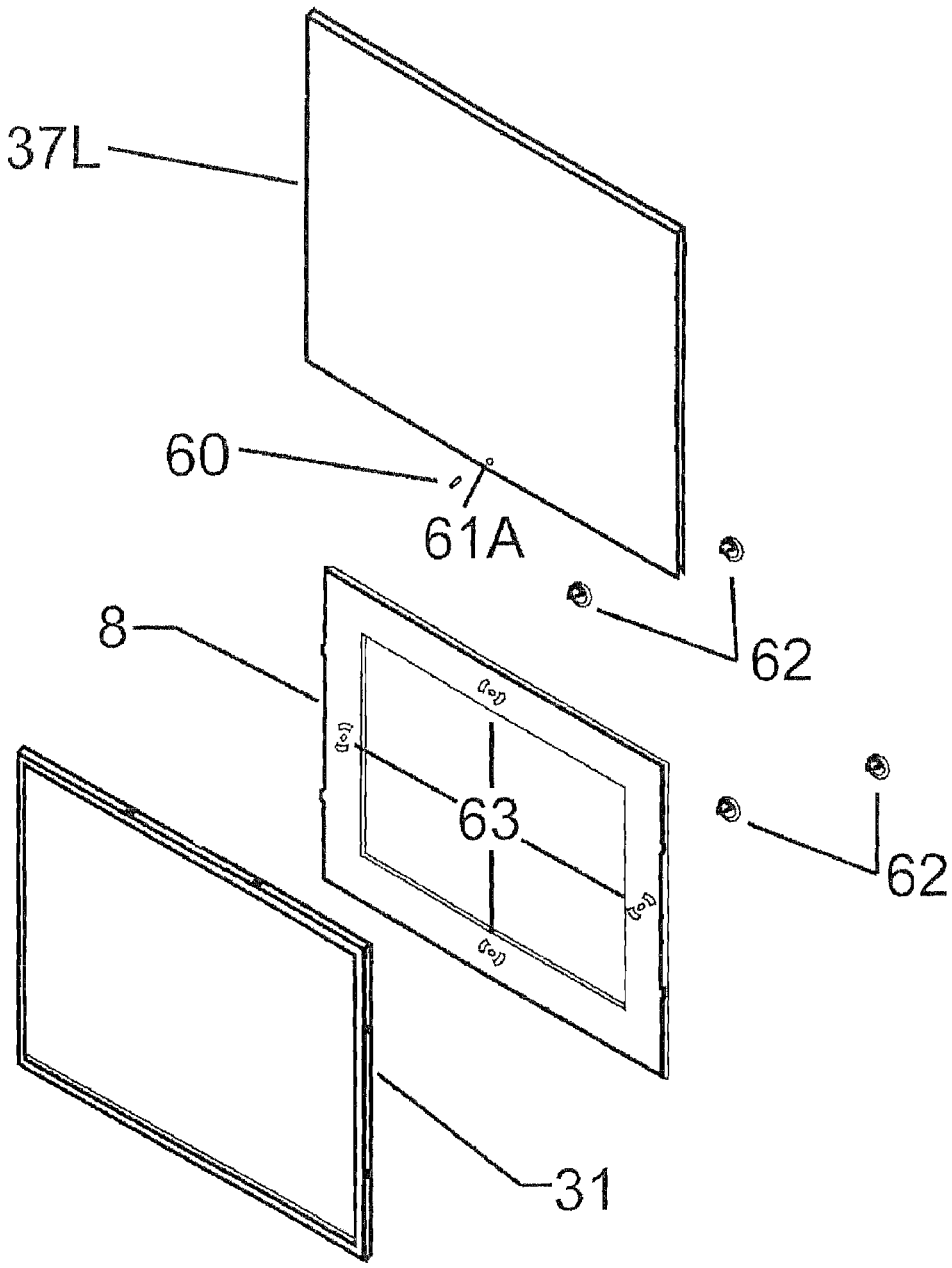
FIG. 19 is of a landscape-oriented, eight-piece folded frame, including exploded frontal views.
Figure 20:
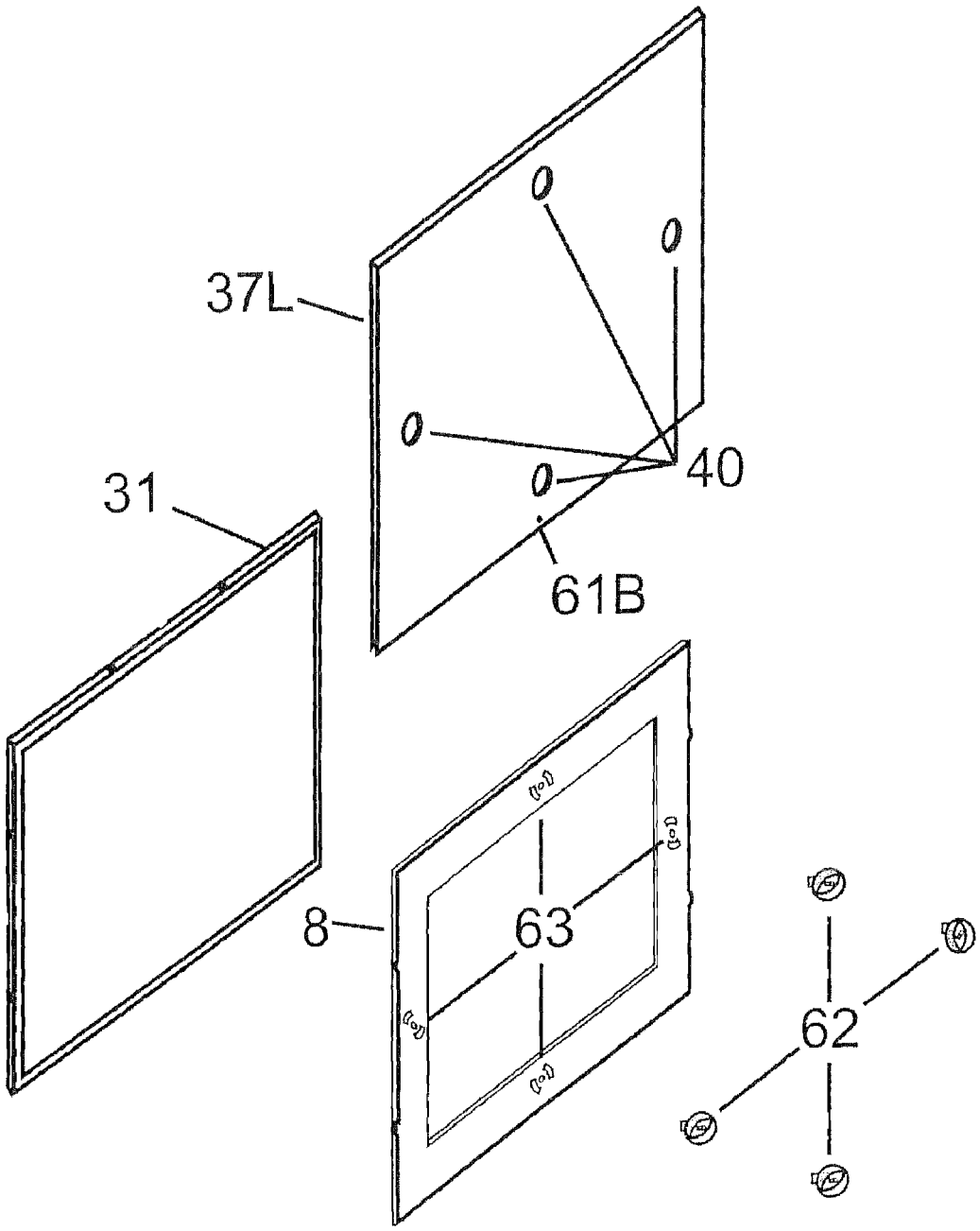
FIG. 20 is of a landscape-oriented, eight-piece folded frame, including exploded rear views.

FIG. 19 and FIG. 20 provide frontal and rear exploded views, respectively, of a sample landscape-oriented eight-piece folded frame 23. The eight pieces of this frame include a landscape-oriented folded outer glazing 37L, a front spacer 31, a middle ledge 8, an outer-glazing closure device 60, and four rotating hanging-bumper devices 62. The rotating hanging-bumper devices 62 in this example are inserted through the outer-glazing bumper holes 40 and attach to the middle ledge 8 using the rotating hanging-bumper point-of-attachments 63. This configuration joins the back of the folded outer glazing 37L to the inside assembly 34 by rotating the rotating hanging-bumper devices 62 a clockwise quarter-turn. The outer-glazing closure device 60 prevents the front and back of the folded outer glazing 37L from opening beyond the width of the inside assembly 34 at the open end of the folded outer glazing 37L. The outer-glazing closure device 60 is inserted through the front- and back-outer-glazing closure holes 61A and 61B from the front of the folded outer glazing 37L. The assembled folded frame 23 can be easily reopened by turning the rotating hanging-bumper devices 61 counter-clockwise a quarter turn, and removing outer-glazing closure device 60 from the outer-glazing closure holes 61A and 61B.

Figure 21:
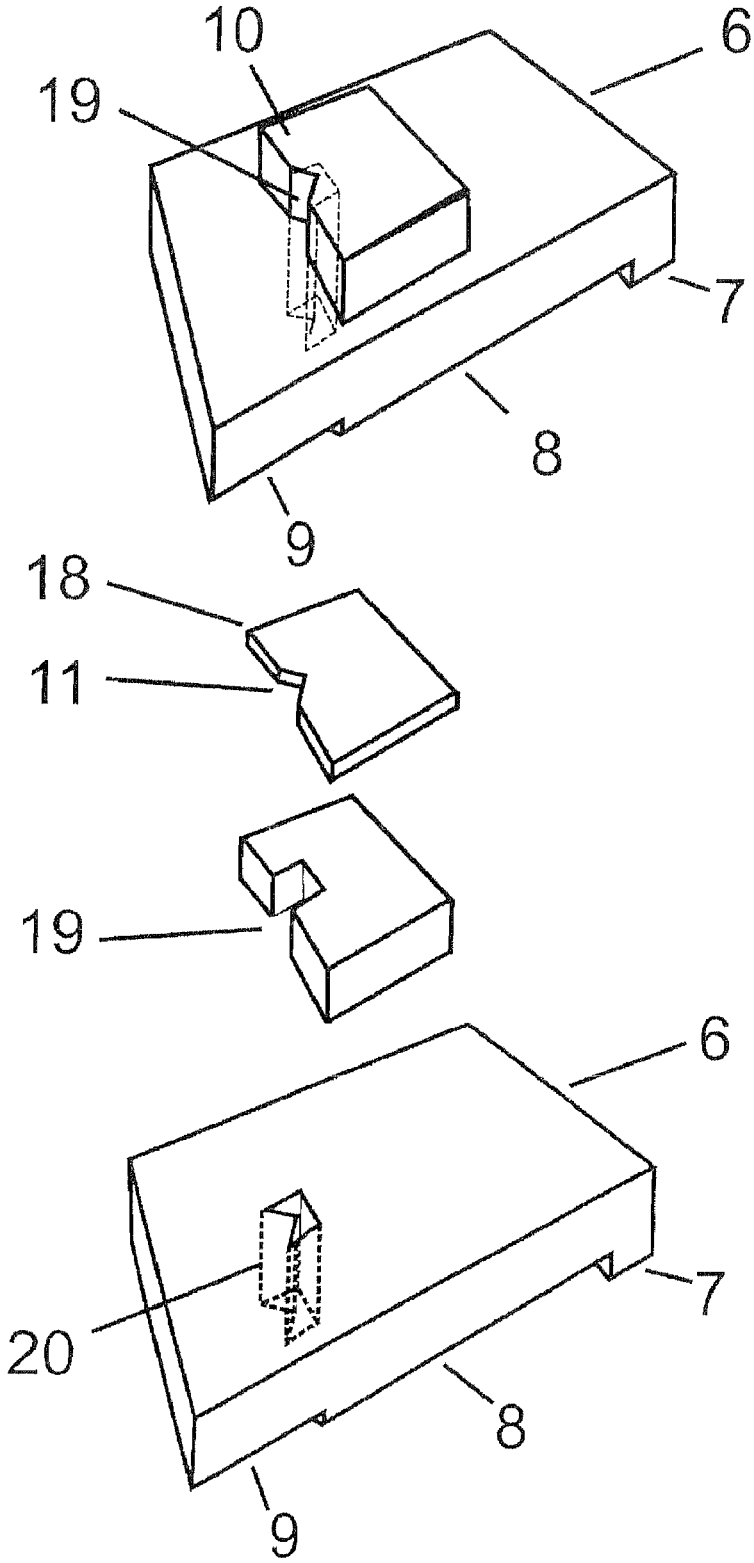
FIG. 21 is of an attached hanging-bumper device, including an enlarged and exploded view.

FIG. 21 provides a detailed view of a hanging-bumper device 10 that is attached to a portion of the back panel 6, and illustrates the geometry of the hanging-bumper device 10 by exploding its features into a rear-most lip layer 18, slot layer 19, and middle-ledge hole 20. These three features of the hanging-bumper device 10 are all of one piece when the back panel 6 is created by injection molding, and are shown as separate layers in FIG. 21 only for the purpose of illustration. The hanging-bumper-device slot 11 is cut into the rear-most lip layer 18 of the hanging-bumper device 10. The hanging-bumper device 10 is intended to be used with a nail or hook that has been inserted into a wall at an angle. The part of the nail or hook that protrudes from the wall catches onto the hanging-bumper-device slot 11 of the lip layer 18 of the hanging-bumper device 10. The protruding nail or hook enters the opening in the slot layer 19 of the hanging-bumper device 10, which is behind the lip layer 18, and can continue into the middle-ledge hole 20, which is cut through the entire thickness of the middle ledge 8 of the back panel 6. The flat portions of the lower edge of the slot layer 19 on either side of the opening, make it easy to find the opening when hanging the display frame 13 on the wall. The three-dimensional configuration of the hanging-bumper device 10 is such that it prevents an angularly inserted nail or hook from slipping from its angle. It performs this function with inversely aligned and stepped shapes, which are illustrated in FIG. 21 as the negative (open) triangular hanging-bumper-device slot 11 of the lip layer 18 and the positive (closed) triangle that protrudes into the otherwise rectangular middle-ledge hole 20. The nail or hook can only fully enter the slot layer 19 under the hanging-bumper-device slot 11 at an angle, because of the step-aligned, three-dimensional, inverse relationship of the positive (closed) triangle to the negative (open) triangle. By retaining the angularity of the nail or hook, the design of the hanging-bumper device 10 aids the long-term stability of the display frame as hung on the wall. The three-dimensional configuration of the hanging-bumper device 10 also prevents the angled nail or hook from touching or damaging contents 5 and 12. The hanging-bumper devices 10 can be of different shapes and sizes and can utilize hanging slots 11 of varying shapes and sizes, in addition to the triangular shape that is illustrated in FIG. 2 and FIG. 21. Beveled and curved examples of the hanging-bumper device 10 are illustrated in FIG. 4. If the hanging-bumper device 10 is manufactured with no middle-ledge hole 20, it can be joined to the back panel 6 with glue or by another method. The hanging-bumper device 10 can also have lips, slots and holes of different shapes, angles, curvatures, sizes, and materials. On larger frames, there can be two or more hanging-bumper devices 10 on each dimension for a total of eight or more hanging-bumper devices 10.

Figure 22:
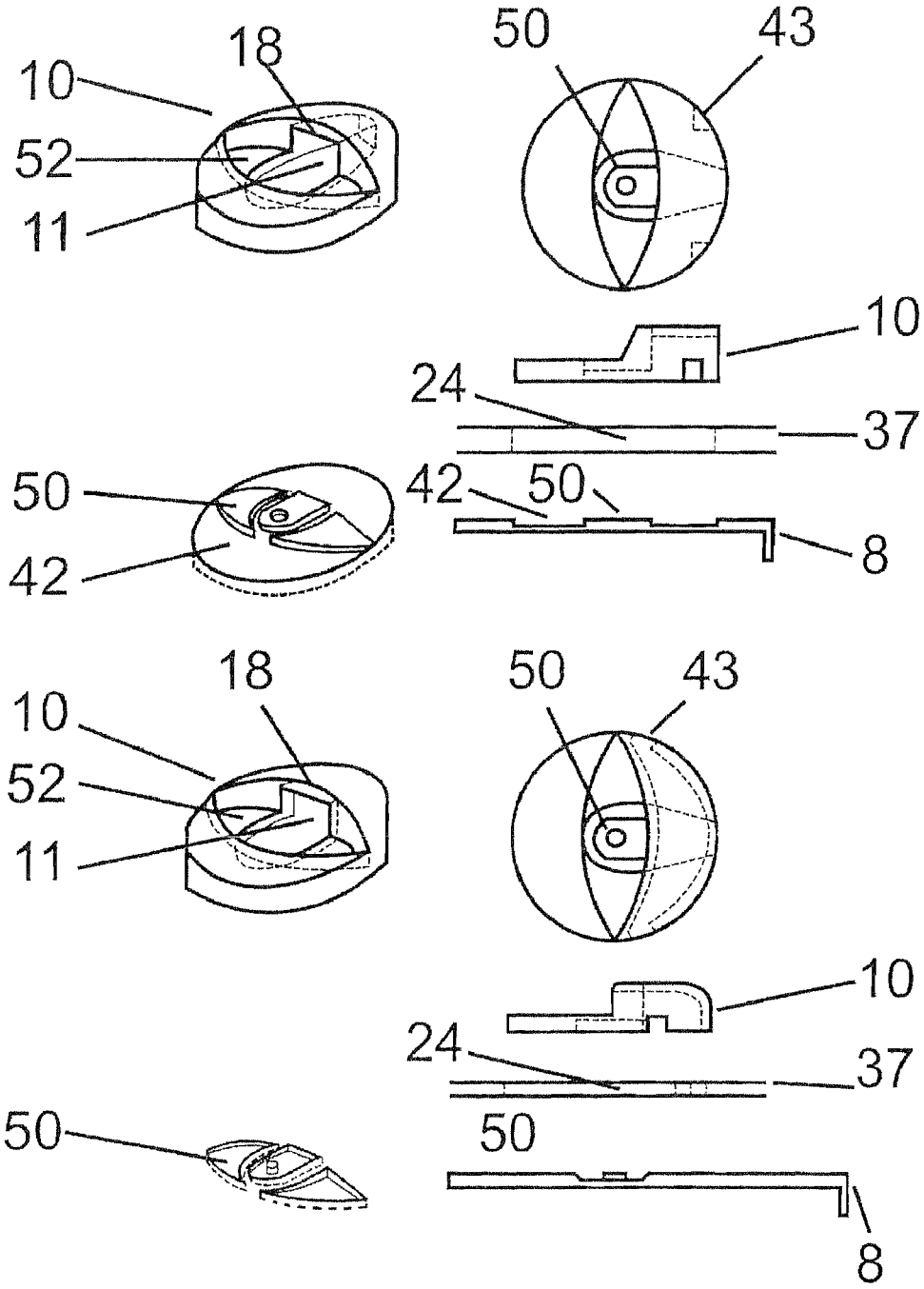
FIG. 22 is of sample independent hanging-bumper devices, including enlarged, frontal, and cross-sectional views of hanging-bumper devices, and cross-sectional views of outer-glazing hanging-bumper-device holes and middle-ledge indentations.

FIG. 22 shows two samples of hanging-bumper devices 10 that are not of one piece with the middle ledge 8, but rather, are glued, welded, or otherwise attached to the back of the folded outer glazing 37. The orientation notches 43 ensure that the hanging-bumper-device slot 11 opens downward to accept a picture hook from the proper position. Various indented and debossed areas of the middle ledge 8 as in examples 42 and 50 provide additional space for the picture hook while protecting the front- and back-facing contents 5 and 12 from puncture. The indented and debossed areas of the middle ledge 8 as in examples 42 and 50 also enable logos and other cosmetic marks to be seen from the back of the folded frame 23. The two examples of hanging-bumper devices 10 in FIG. 22 show different shapes incorporating hanging-bumper-device slots 11, hanging-bumper-device lip layers 18, debossed features 50 and 52, and an embossed feature 42.

Figure 23:
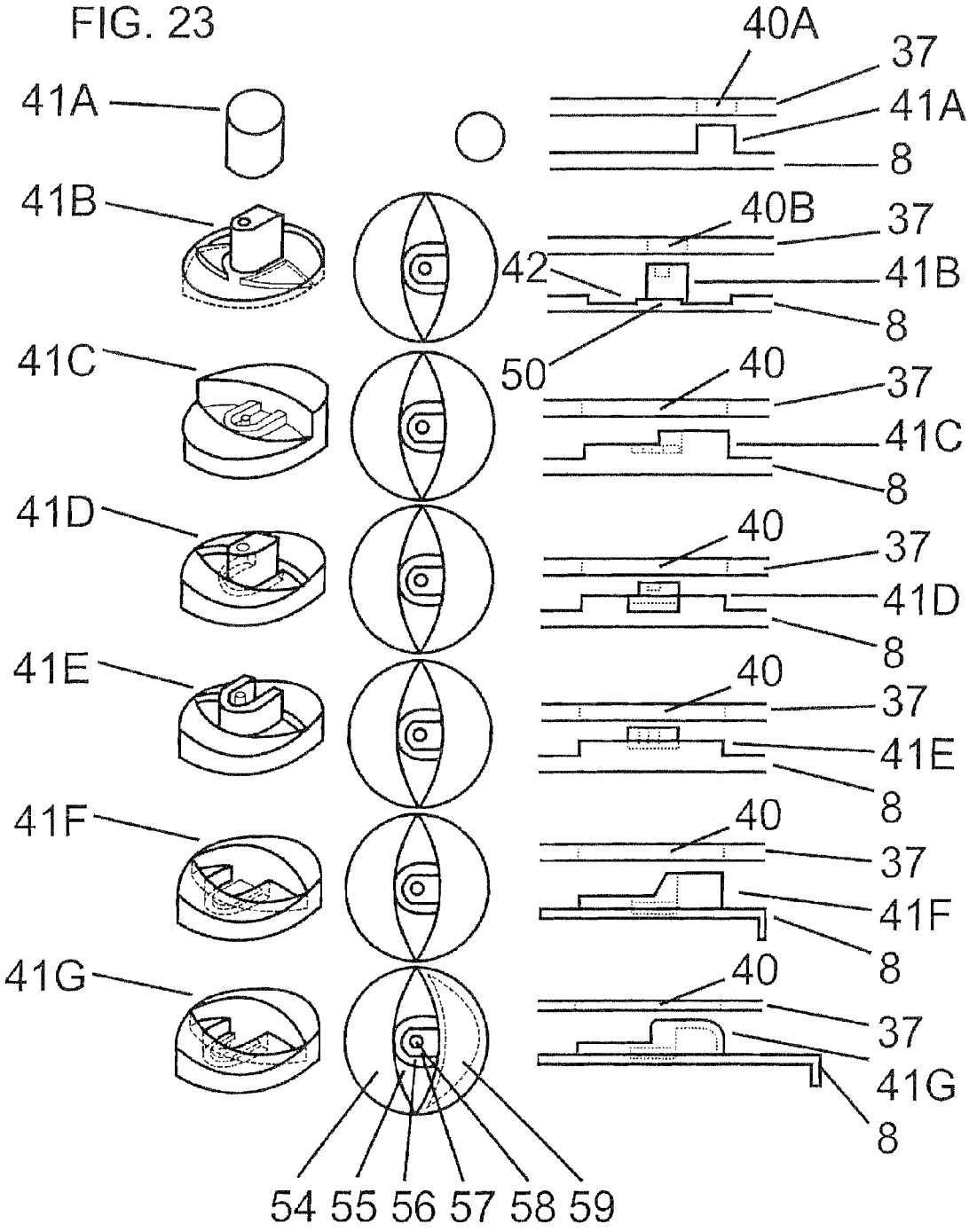
FIG. 23 is of sample attached bumpers, including enlarged, frontal, and cross-sectional views of bumpers, and cross-sectional views of sample outer-glazing bumper holes and middle-ledge configurations.

FIG. 23 shows a sample variety of middle-ledge bumper 41 shapes, including cross-sectional views of middle-ledge 8 configurations and outer-glazing bumper holes 40. These bumper features can range from a simple cylindrical shape as in bumper 41A to any number of shapes as in 41B through 41G. In these examples, various elevations are portrayed for a given set of cosmetic features numbered 54 through 59, which mimic the sample shapes of the hanging-bumper devices illustrated in FIG. 22 in order to provide symmetry to the look of the back of the assembled folded frame 23. The middle-ledge bumpers 41B through 41F all look identical from a frontal view even if made from transparent material despite the varied elevations in their configurations. Middle-ledge bumper 41G is an example that is partially hollowed out from the bottom under cosmetic feature 59, which would not be visible if opaque material is used. Other areas of these middle-ledge bumper variations can also be hollowed out to aid in their manufacture.

Figure 24:
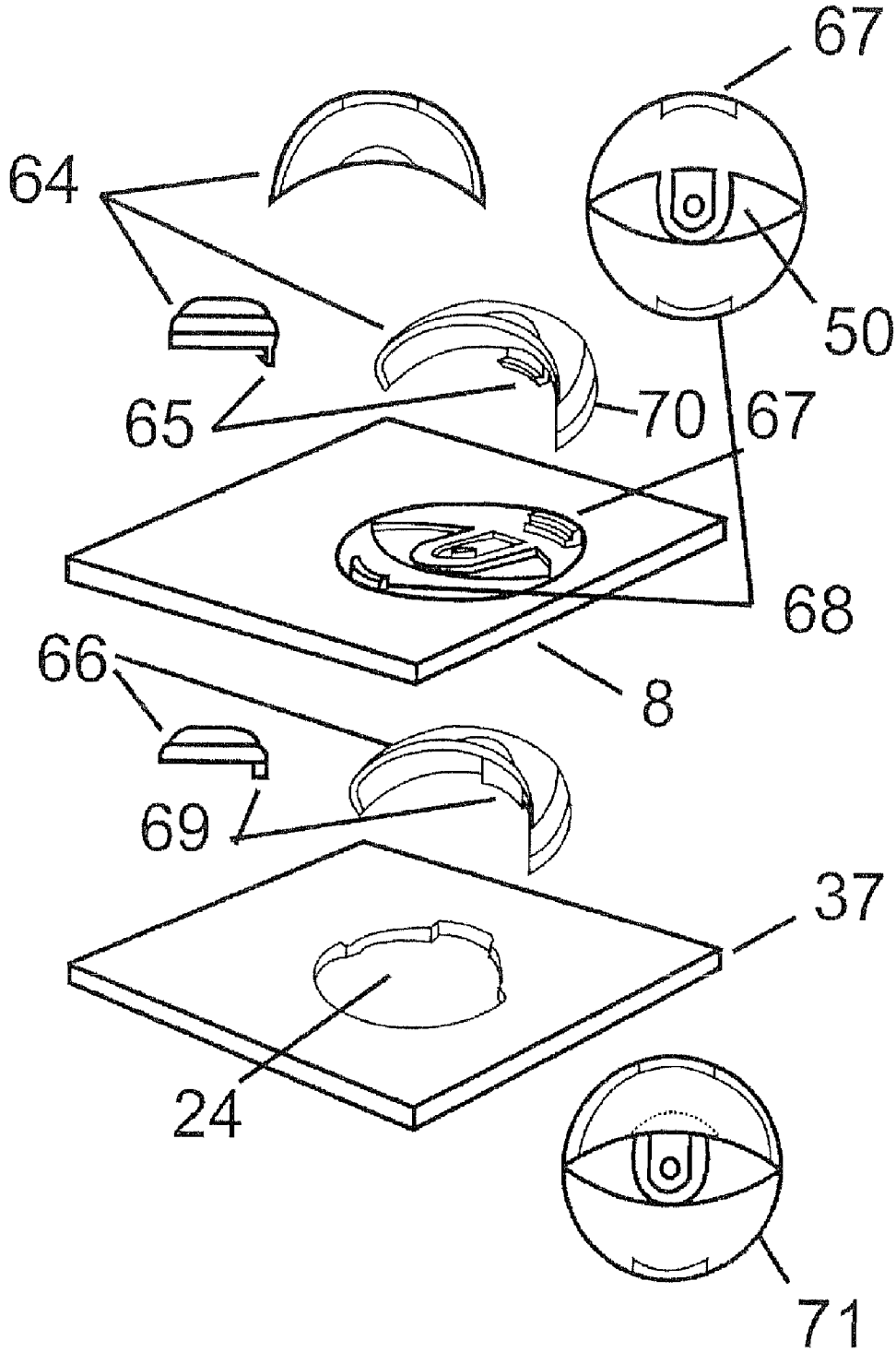
FIG. 24 is of a snapped bumper and snapped hanging-bumper device, including enlarged and cross-sectional views of the bumper and hanging-bumper device, and exploded views of a middle-ledge point of attachment.

FIG. 24 shows exploded, rear, cross-sectional, unassembled and assembled views of a snap hanging-bumper device 64 and a band-shell hanging-bumper device 66. These variations to the bumper and hanging-bumper devices involve a snap 65 that attaches the snap hanging-bumper device 64 to the middle ledge 8 by snapping into a middle-ledge counter-bore hole 67. A reverse taper 70 at the base of the snap hanging-bumper device 64 provides friction that secures the back of the folded outer glazing 37 against the middle ledge 8. The middle-ledge positioning tab 68 facilitates the location of the outer-glazing bumper holes 40 (not shown in FIG. 24) and the outer-glazing hanging-bumper-device hole 24 for properly positioning the inside assembly 34 between the folded outer glazing 37. The band-shell hanging-bumper device 66 is glued or otherwise affixed to the outer-glazing hanging-bumper-device hole 24. An orientation tab 69 properly positions the band-shell hanging-bumper-device bumper 66 onto the outer-glazing hanging-bumper-device hole 24. These snap hanging-bumper device 64 and band-shell hanging-bumper-device 71 appear identical form the back of the assembled folded frame 23, even though their shapes and functions are different, and even if they are made of entirely transparent material. The overall effect of these features is to provide a symmetrical appearance from the back of the assembled folded frame 23.

Figure 25:
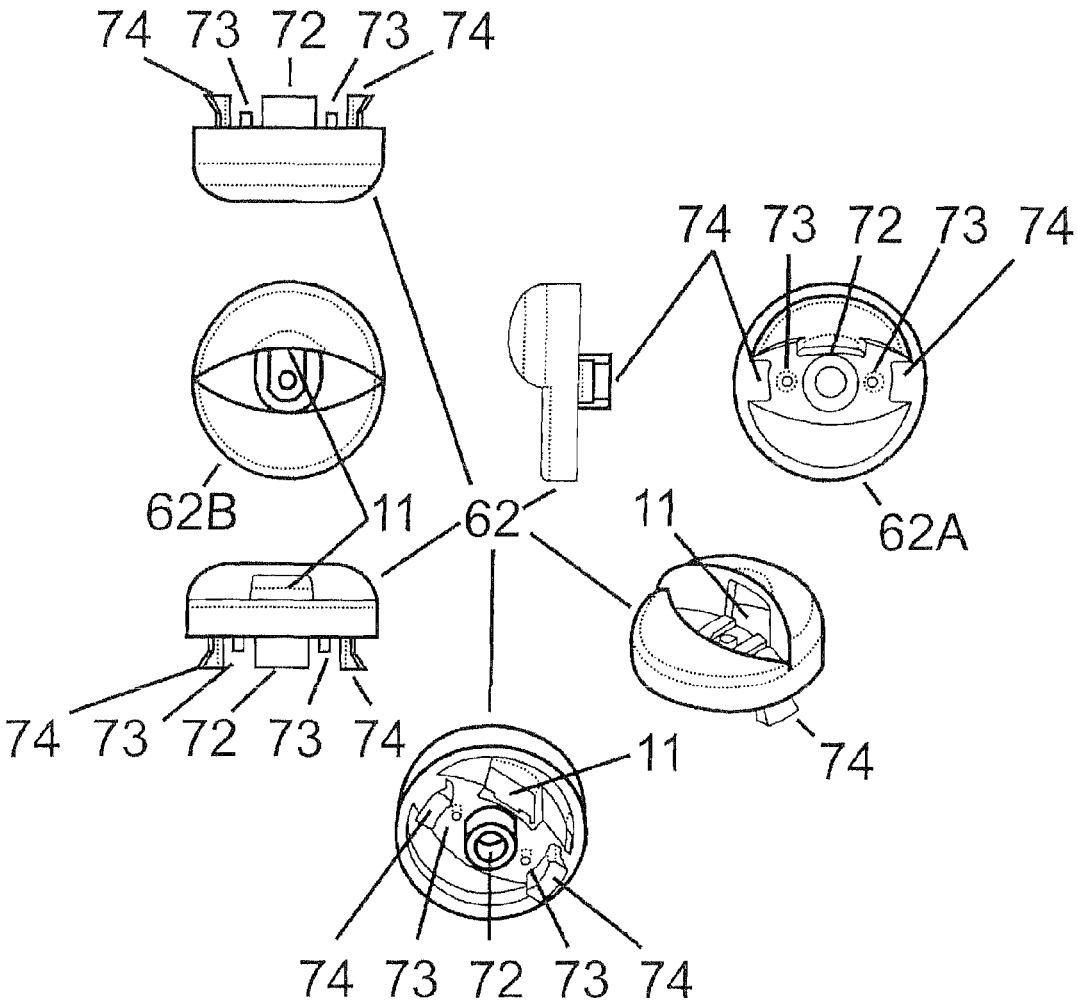
FIG. 25 is of a rotating hanging-bumper device, including frontal, rear, side, and three-dimensional views of a sample hanging-bumper device.

FIG. 25 shows frontal, rear, cross-sectional and various three-dimensional views of a sample rotating hanging-bumper device 62. The back of the rotating hanging-bumper device 62B is seen from the back of the assembled folded frame 23 and can largely hide or reveal the hanging-bumper device slot 11 that accepts a picture hook or nail for hanging the frame on a wall. FIG. 25 illustrates that the back of the rotating hanging-bumper device 62 can have a variety of cosmetic features and shapes. The front of the rotating hanging-bumper device 62A has several functional features, including two rotating tabs 74, two friction pins 73, and a rotating boss 72 in the center.

Figure 26:
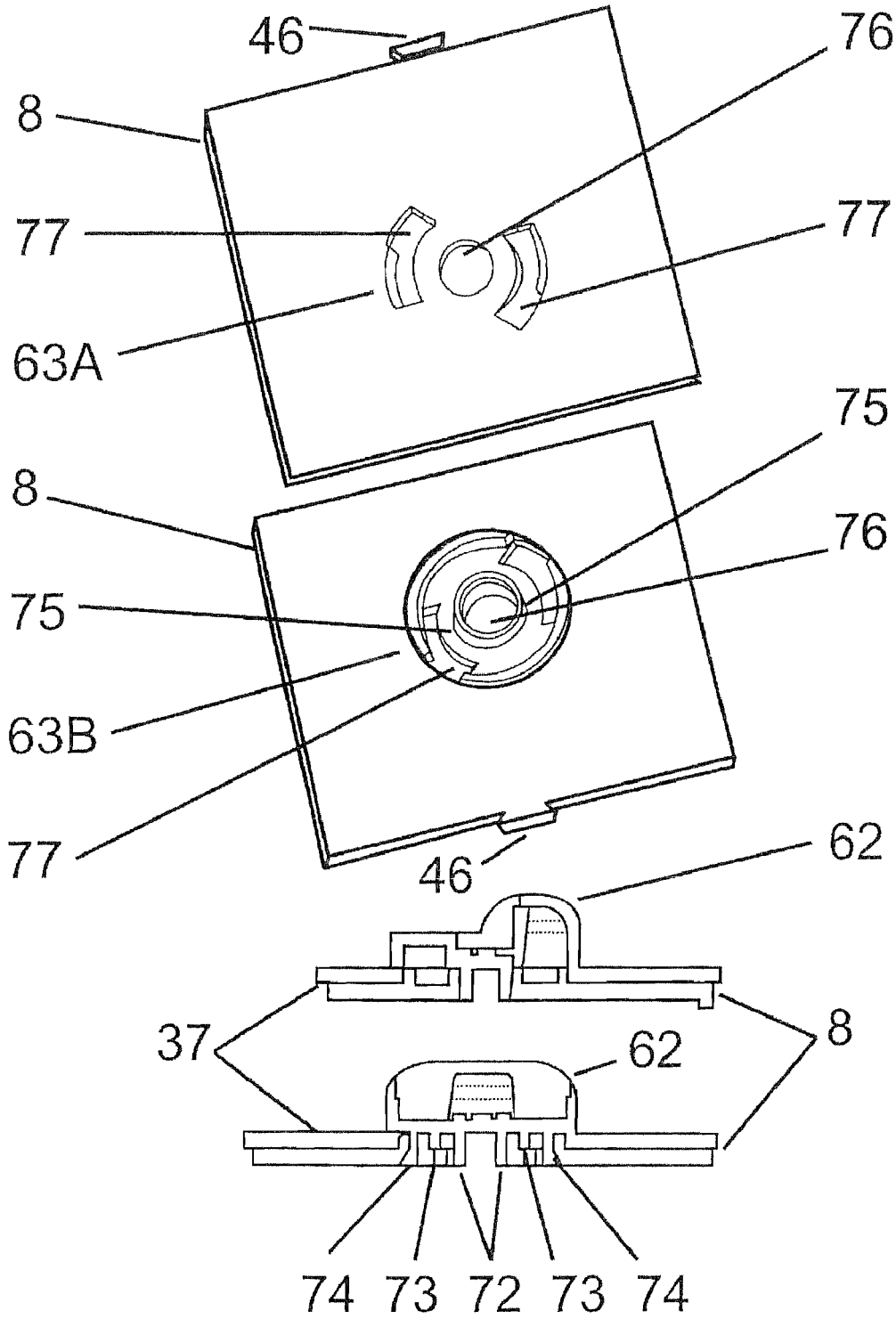
FIG. 26 is of a rotating hanging-bumper device, including cross-sectional views of an assembled hanging-bumper device, and enlarged frontal and rear views of a middle-ledge point of attachment.

FIG. 26 illustrates how the functional features on the front of the rotating hanging-bumper device 62A secure the outer glazing 37 to the middle ledge 8. FIG. 26 shows points of attachment 63 on the middle ledge 8 for the rotating hanging-bumper device 62. FIG. 26 also shows cross-sectional views of a rotating hanging-bumper device 62 assembled onto the folded outer glazing 37 and middle ledge 8. The rotating tabs 74 enter the middle-ledge rotating-tab holes 77. The friction pins 73 rub against the middle-ledge friction ramps 75, preventing the fully rotated rotating hanging-bumper device 62 from rotating unless it is intentionally turned counter-clockwise to re-open the assembled folded frame 23. The rotation boss 72 sits in the middle-ledge boss hole 76, orienting the turning action and providing a strong point for holding the weight of the frame when hung. The outer perimeter of the rotating hanging-bumper device 62 is larger than the diameter of the outer-glazing bumper holes 40, which enables the hanging-bumper device 62 to hold the folded outer-glazing 37 securely against the middle ledge 8.

Figure 27:
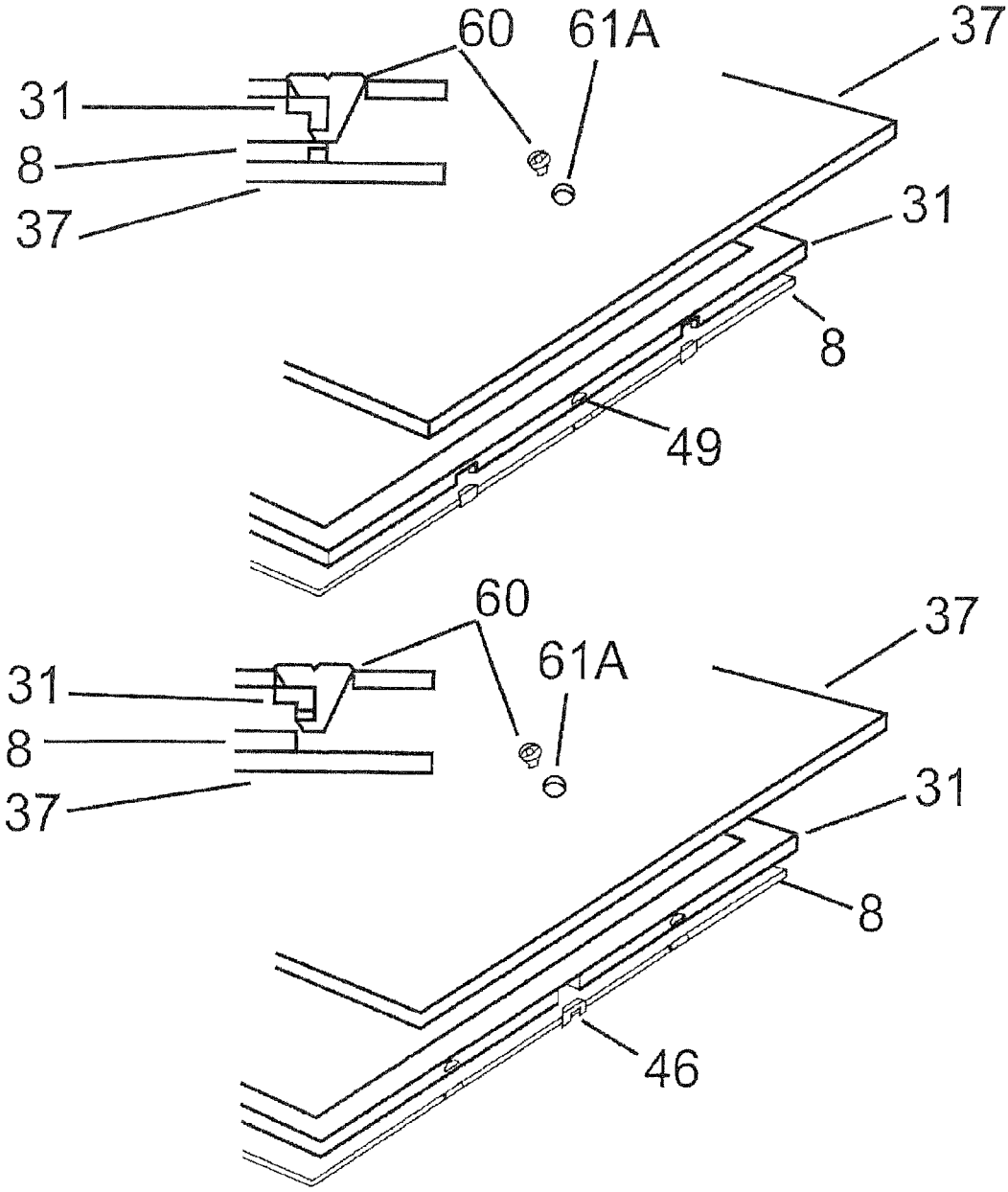
FIG. 27 is of sample folded outer-glazing closure devices, including cross-sectional and exploded views of two configurations.
Figure 28:
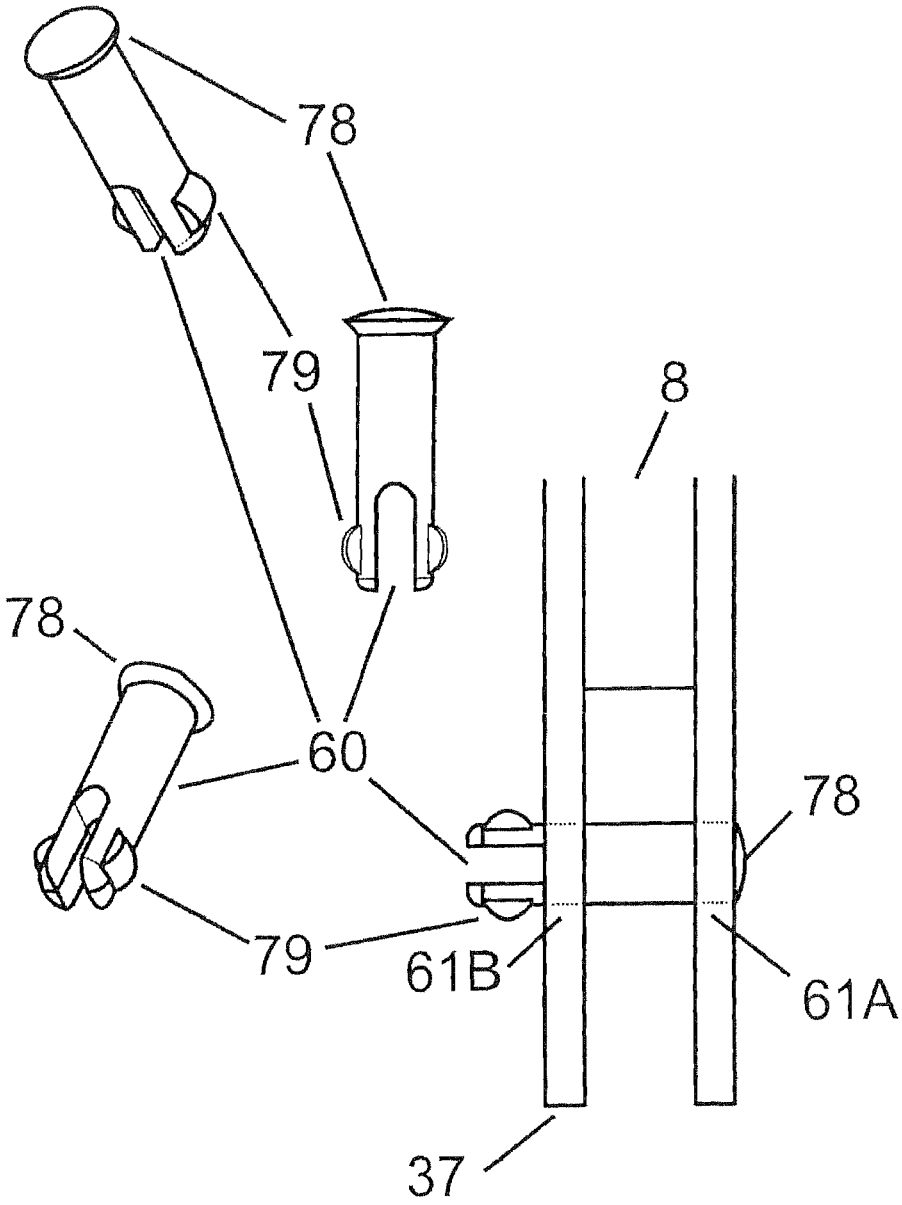
FIG. 28 is of a folded outer-glazing closure device, including enlarged, cross-sectional and assembled views.

FIG. 27 and FIG. 28 show two samples of folded outer-glazing closure devices 60, including cross-sectional and exploded views of three configurations. FIG. 27 shows how an outer-glazing closure device 60 can be inserted into a single outer-glazing closure device hole 61A from the front of the folded outer glazing 37, and can hook into elements of either the front spacer 31 or the middle ledge 8. FIG. 27 shows examples of an outer-glazing closure device 60 hooking into a front-spacer under-hold hole 49 and into a hollowed-out middle-ledge dovetail 46. By securing the front of the folded outer glazing 37 to the inside assembly 34, the outer-glazing closure device 60 prevents the front of the outer glazing from opening at its unfolded end. FIG. 28. shows another version of an outer-glazing closure device 60, which is inserted into outer-glazing closure device holes 61A and 61B in both the front and back panels of the folded outer glazing 37. The outer-glazing closure device 60 is held in place by features at both of its ends that are wider than the diameters of the outer-glazing closure-device holes 61A and 61B, including a closure-device head 78 on one end and two closure-device prongs 79 with nubs on the other end. The two-pronged outer-glazing closure device 60 prevents the folded outer glazing 37 from opening at its unfolded end either in front or in back beyond the width necessary to accommodate the inside assembly 34.

Figure 29:
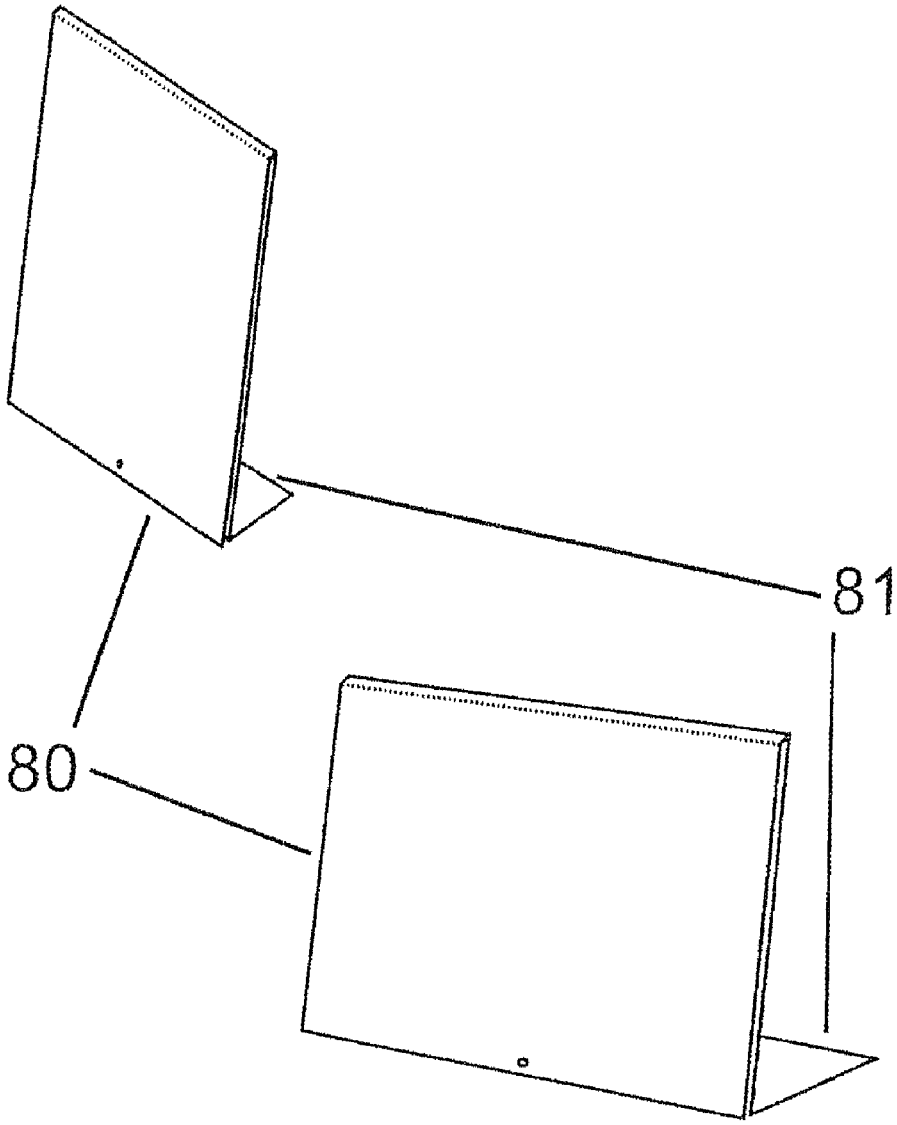
FIG. 29 is of sample standing folded outer glazings, including frontal views.

FIG. 29 shows two samples of standing outer glazing 80. The standing outer glazing 80 can stand on any horizontal surface though the use of a tail base 81. The tail base 81 can be created with a second fold to the outer glazing, or with a hinge or other device that secures the base to the outer glazing.

Figure 30:
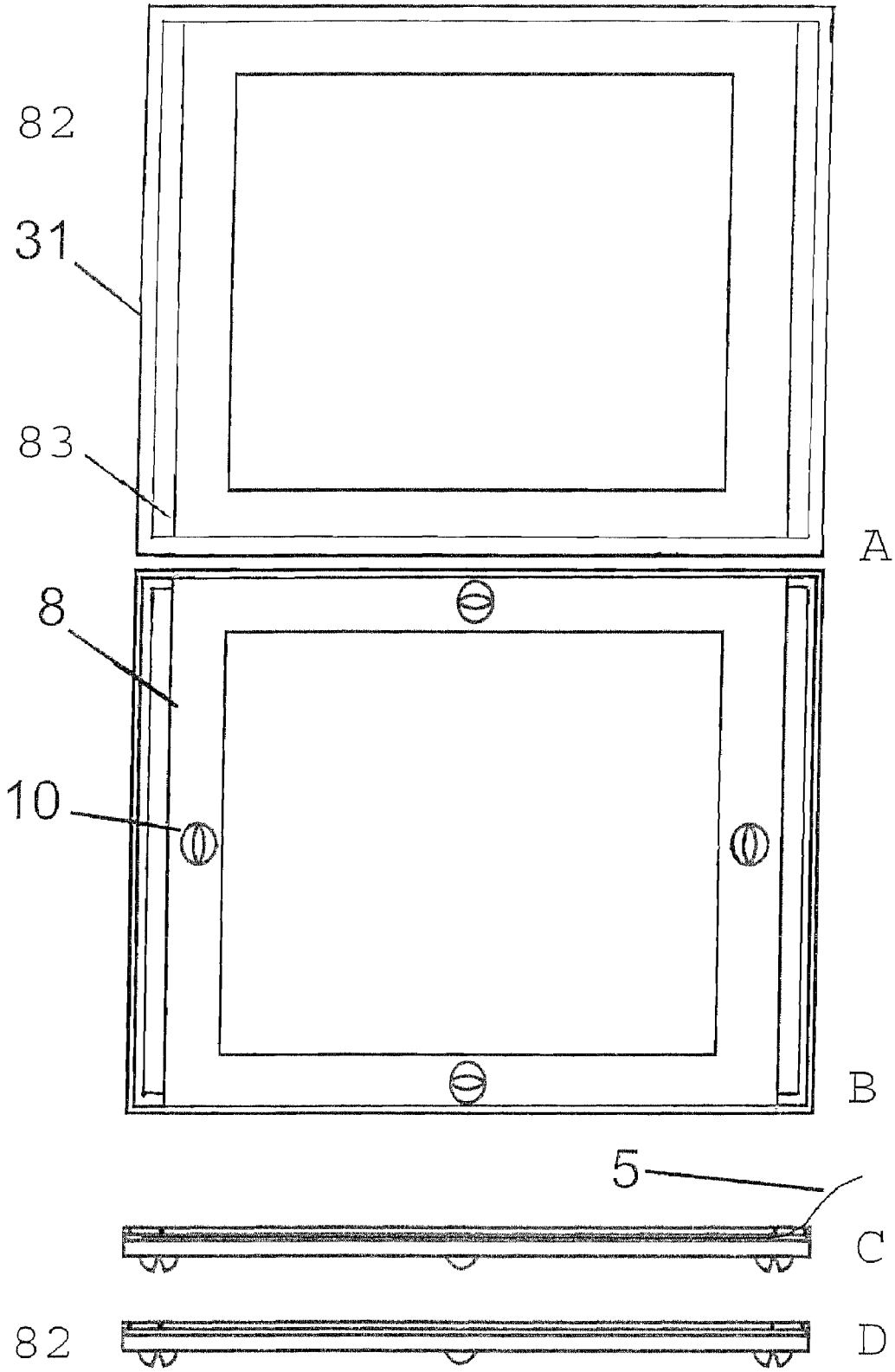
FIG. 30 illustrates a one piece inside assembly in accordance with the present invention.

FIG. 30 shows frontal (A), rear (B), assembled (C) and cross-sectional (D) views of a one-piece integrated inside assembly 82. Integrated inside assembly 82 has its front spacer 31, middle ledge 8, and hanging-bumper-device 10 all formed in one piece by injection molding. To facilitate the insertion of content, middle ledge 8 has two parallel ends shorter than that of the front spacer; thereby two open slits 83 are formed between each end of middle ledge 8 and corresponding ends of the front spacer 31.

As shown in view B of FIG. 30, the back side of one-piece inside assembly 82 has four hanging-bumper-devices 10 that are formed by the same injection molding process. The rounded profile of this version of the hanging-bumper devices 10 facilitate the inside assembly 82 being snapped into place and held firmly by the folded outer glazing 37. As indicated in FIG. 12, the hanging-bumper devices can have various profiles.

Views A and B in FIG. 30 illustrate frontal and rear views of one-piece inside assembly 82. Inside assembly 82 provides a space for and holds in place the front- and/or back-facing contents 5 or 12. View C of FIG. 30C illustrates a content being inserted through the open slit 83 into the inside assembly. The front spacer 31 separates the content 5 or 12 from the outer glazing. The content displayed by this embodiment can be front-facing or back-facing. The content 5 or 12 is secured within this inside assembly 82, which is inserted between the folded outer glazing. Inside assembly 82 can be in triangular, semicircular, and other shape, so long as the one-piece injected inside assembly provides at least an open slit for the insertion of a content.

Figure 31:
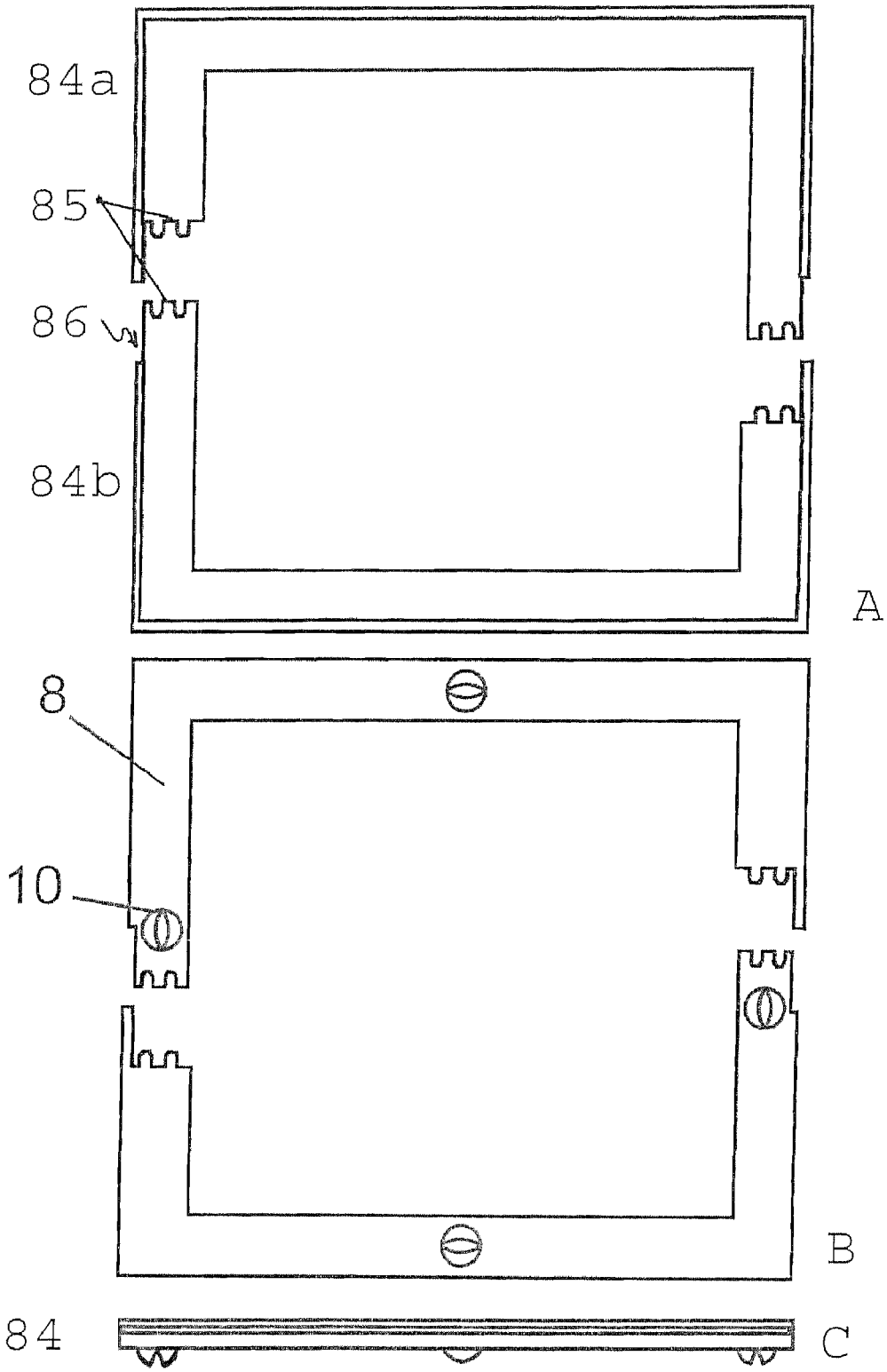
FIG. 31 illustrates another embodiment of a two piece inside assembly in accordance with the present invention.

FIG. 31 is an embodiment of two-part interlocking inside assembly 84 for being inserted into a folded outer glazing, including unassembled frontal (A) and rear (B), and assembled cross-sectional (C) views. Each of the two parts 84*a*, 84*b* includes a front spacer 31, a middle ledge 8 and hanging bumper devices 10 formed by injection molding into one integrate piece. Interlocking means 85 is provided at each corresponding ends of the separated piece of the inside assembly for interlocking the two pieces into a secured fixation. The interlocking means can include a wide variety of interlocking configurations involving dovetails, lips, walls, ledges, snaps, indentations, sliding channels, and other function or displacement arrangements.

In this embodiment, the front- or back-facing contents 5 or 12 can be insert through slot 86 between the front spacer 31 and the middle ledge 8 prior to assembly of two-part inside assembly 84. By interlocking the two parts into one inside assembly, the content are secured inside thereof.

Assembled inside assembly 84 can be inserted into a rectangular outer glazing 37 along the shorter width of the rectangle or along the longer length of the rectangle, forming a frame with an outer glazing.

In the embodiments of FIGS. 30 and 31, the hanging-bumper devices 10 are provided as an integrated member at the middle ledge by the same injection molding process. These integrated hanging-bumper devices 10 are fixed through the outer-glazing bumper holes 40 as indicated in FIG. 15 to facilitate hanging and lock the inside assembly in place to the back of the folded outer glazing For these embodiments, the outer-glazing closure device 60 prevents the front and back of the folded outer glazing from opening beyond the width of the inside assembly at the open end of the folded outer glazing.

The content in the above assembled folded frames can be easily replaced. This can be done by removing outer-glazing closure device 60 from the outer-glazing closure holes 61A and 61B, opening the folded outer glazing a little to retreat the hanging-bumper devices 10 from the holes 40, and then pull the inside assembly out. The content in the one-piece inside assembly can be removed by pulling and sliding the content out from the open slits 83 provided on inside assembly 82. The content in two-part inside assembly 84 can be removed by unlocking interlocking means 85 and separating two parts 84*a*, 84*b* to access the content through slot 86.

LIST OF FEATURES

Front panel 1
Front glazing 2
Inner friction clamp 3
Outer perimeter 4
Front-facing content 5
Back panel 6
Outer friction clamp 7
Middle ledge 8
Back glazing 9

-continued

Hanging-bumper device 10
Hanging-bumper-device slot 11
Back-facing content 12
Assembled frame 13
Undercut snap fit 14
Beveled outermost edge 15
Rounded outermost edge 16
Additional thickness or layer 17
Hanging-bumper-device lip layer 18
Hanging-bumper-device slot layer 19
Hanging-bumper-device shut-off hole 20
Overhang friction clamp 21
Four-piece panel frame 22
Folded frame 23
Outer-glazing hanging-bumper-device hole 24
Short rounded end 25
Back-glazing lip 26
Inner groove 27
Front-glazing lip 28
Outer groove 29
Back-panel outer lip 30
Front spacer 31
Front-spacer outer lip 32
Middle-ledge outer lip 33
Inside assembly 34
Outer glazing 35
Outer glazing (portrait orientation) 35P
Outer glazing (landscape orientation) 35L
Outer-glazing fold line 36
Outer-glazing fold line (portrait) 36P
Outer-glazing fold line (landscape) 36L
Outer glazing folded 37
Outer glazing folded (portrait) 37P
Outer glazing folded (landscape) 37L
Folded frame (front) 38
Folded frame (back) 39
Outer-glazing bumper holes 40
Middle-ledge bumpers 41
Middle-ledge circle indentation 42
Hanging-bumper-device orientation notches 43
Label-holder fold line 44
Label holder folded 45
Dovetail 46
Under-hold tab 47
Dovetail slot 48
Under-hold hole 49
Middle-ledge eyecon feature 50
Label-holder hanging hole 51
Hanging-bumper-device sclera 52
Middle-ledge under-hold-slot lip layer 53
Middle-ledge bumper lower lid 54
Middle-ledge bumper sclera 55
Middle-ledge bumper outer U 56
Middle-ledge bumper inner U 57
Middle-ledge bumper center O 58
Middle-ledge bumper upper lid 59
Outer-glazing closure device 60
Outer-glazing closure-device hole (front) 61A
Outer-glazing closure-device hole (back) 61B
Rotating hanging-bumper device 62
Rotating hanging-bumper device (front) 62A
Rotating hanging-bumper device (back) 62B
Rotating bumper point-of-attachment 63
Rotating bumper point-of-attachment (front) 63A
Rotating bumper point-of-attachment (back) 63B
Snap hanging-bumper device 64
Hanging-bumper-device snap 65
Band-shell hanging-bumper device 66
Middle-ledge counter-bore hole 67
Middle-ledge positioning tab 68
Band-shell hanger positioning tab 69
Reverse taper 70

-continued

Assembled band-shell bumper 71
Rotation boss 72
Friction pin 73
Rotating tab 74
Friction ramp 75
Boss hole 76
Rotating-tab hole 77
Closure-device head 78
Closure-device prongs 79
Standing outer glazing 80
Tail base 81
One-piece Inside Assembly 82
Open slit 83
Two-part Inside Assembly 84
Upper integrate part of the inside assembly 84a
Lower integrate part of the inside assembly 84b
Interlocking means 85
Open slot 86

I claim:

1. A display frame with content for displaying comprising:

an inner frame member, having a front frame part a back frame part and a content between the front frame part and the back frame part;

an open area surrounded by said inner frame member for viewing a front and a back of the content;

a perimeter space between the front frame part and the back frame part, the perimeter space delimited above by a perimeter ledge of said front frame part and below by a perimeter ledge of said back frame part;

a perimeter edge of said content in the perimeter space and the perimeter edge of the content perpendicularly held only by and between the perimeter ledge of said front frame part and the perimeter ledge of said back frame part;

a fixing means for holding said front frame part and said back frame part together;

the front frame part having a transparent front panel and the back frame part having a transparent back panel, the transparent front panel and the transparent back panel covering said open area of said inner frame member and covering the front and the back of the content; and the transparent front panel separated from the front of the content by a front space and the transparent back panel separated from the back of the content by a back space, such that the front of the content and the back of the content are visible.

2. The display frame of claim 1 wherein the perimeter ledge of the front frame part is part of an inner frictional clamp affixed to said front frame part and the perimeter ledge of the back frame part is part of an outer friction clamp affixed to said back frame part; and the inner frictional clamp and the outer frictional clamp provide the fixing means for holding the front frame part and the back frame part together.

3. The display frame of claim 1 further comprising a hanging-bumper device affixed to said back frame part on an outside surface of said back frame part.

4. The display frame of claim 1 wherein said transparent front panel is integral with said front frame part and said transparent back panel is integral with said back frame part.

* * * * *